US011739951B2

(12) United States Patent
Martire

(10) Patent No.: US 11,739,951 B2
(45) Date of Patent: Aug. 29, 2023

(54) OVERFLOW PREVENTER FOR SEWERAGE AND DRAINAGE SYSTEMS

(71) Applicant: Louis Martire, Brooklyn, NY (US)

(72) Inventor: Louis Martire, Brooklyn, NY (US)

( * ) Notice: Subject to any disclaimer, the term of this patent is extended or adjusted under 35 U.S.C. 154(b) by 0 days.

(21) Appl. No.: 17/670,564

(22) Filed: Feb. 14, 2022

(65) Prior Publication Data

US 2022/0170647 A1 Jun. 2, 2022

Related U.S. Application Data

(60) Continuation-in-part of application No. 17/207,630, filed on Mar. 20, 2021, which is a division of application No. 16/032,116, filed on Jul. 11, 2018, now Pat. No. 10,955,143, which is a division of application No. 15/271,061, filed on Sep. 20, 2016, now Pat. No. 10,718,531.

(51) Int. Cl.
*F24D 19/10* (2006.01)
*G08B 21/20* (2006.01)

(52) U.S. Cl.
CPC ..... *F24D 19/1009* (2013.01); *F24D 19/1015* (2013.01); *G08B 21/20* (2013.01); *F24D 2220/046* (2013.01)

(58) Field of Classification Search
USPC ..... 237/8 A
See application file for complete search history.

(56) References Cited

U.S. PATENT DOCUMENTS 5,920,265 A * 7/1999 Johnson, Jr. ..... G01M 3/2815 340/606
2011/0320140 A1* 12/2011 Butler ..... G01M 3/2807 702/45
2016/0289948 A1* 10/2016 Rasmus ..... G08B 21/20
2018/0089981 A1* 3/2018 Walbert ..... G08B 21/20

* cited by examiner

*Primary Examiner* — Steven B McAllister
*Assistant Examiner* — John E Bargero
(74) *Attorney, Agent, or Firm* — Law Offices of Leo Mikityanskiy, P.C.; Leonid Mikityanskiy

(57) ABSTRACT

A residential and commercial sewerage and water drainage safety system and device that includes at least one hollow pipe, with a plugged or sealed top end and a fitting on the bottom end for connecting the pipe in a substantially vertical mounting position into the sewerage or water drainage system, and at least one float switch disposed in the pipe and electrically connected with a water shut off valve, where the pipe is adopted for the flow and accumulation of fluid, so that the float switch activates as the pipe fills with fluid and shuts off the water valve, promoting safer sewerage and water drainage system operation. Additional float switches positioned above or below in the hollow pipe may provide additional functions, such as a warning light and sound to the owner, or a notification via a telephone or cell phone system or through the home network or Wi-Fi system.

20 Claims, 22 Drawing Sheets

1–2 NORMALLY CLOSED CONTACTS TO LIMITS (IN SERIES WITH LIMITS)
3–4 NORMALLY OPEN CONTACTS IN SERIES WITH SOLENOID VALVE/ALARM
5–6 RELAY COIL TERMINALS
7–8 LIMITS
9–10 FLOAT SWITCH
11 24 VOLT HOT
12–13 SOLENOID VALVE/ALARM
14 24 VOLT NEUTRAL

OVERFLOW PREVENTER FOR SEWERAGE AND DRAINAGE SYSTEMS

This invention was not made pursuant to any federally-sponsored research and/or development.

THE FIELD OF INVENTION

The system, device and method of the present invention relate to a device, system and method for improving the safety of residential and commercial hot water and steam boilers, primarily those burning natural gas, commonly used for heating, hot water, and other purposes, and for all other water and steam boilers using combustible liquids and fuels, such as oil and liquefied gas, as well as sewerage and drainage systems. Hot water and water heated to steam have many residential and commercial uses. Hot water and steam are used for cooking, cleaning, bathing, and space heating, to name just a few.

BACKGROUND OF THE INVENTION

Natural gas has been used for hot water and heating for a very long time in the United States. When natural gas is mixed with air in the right proportions, the air of course containing oxygen necessary for burning, natural gas is a clean-burning, efficient, and safe way for hot water and heating purposes. Hot water and heat account for a large portion of the residential energy bill because, according to the U.S. Department of Energy statistics, 14% of the home energy usage is for heating water and 44% is for heating and air conditioning. Thus, the system, device, and method of the present invention have the tremendous potential to improve the safety of the water and heating systems of millions of households.

Numerous devices and systems exist to use the natural gas for hot water and heating. The devices that burn fuel to provide hot water or steam are commonly referred to as water heaters, hot water heaters, hot water tanks, boilers, steam boilers, heat exchangers, and other names known in the art. Some of these devices use electric power instead of fossil fuels, with the possibility of all or some of the electricity being provided by solar power or other renewable energy source. Indeed, a very large industry exists to manufacture, distribute, and service the boilers and steam boilers using natural gas.

The devices and systems using natural gas are constantly improved to increase their safety and efficiency. However, such improvements are usually directed as the devices and systems themselves (i.e., to prevent fires and gas explosions, which are dangerous to the life and safety of individuals using these devices, and are also dangerous to the property. However, no device or method exists to improve the safety of the boilers and steam boilers in terms of water leakage, dripping, and water and steam explosions, either one of which can flood a basement, causing massive damage to the basement and anything in it, further causing secondary damage from mold, short circuits, fires and other issued caused by flooding.

Indeed, natural gas boilers and steam boilers typically have a pressure and/or temperature sensor or sensors. The sensors are sometimes adjustable and sometimes preprogrammed to a certain limit of safe pressure and/or temperature. If the safe pressure and/or temperature is exceeded, a limit switch will typically end the operation of the boiler or heating system by shutting off the gas valve and/or the burner.

The limit stitches are used on both residential and commercial boiler and heating systems. The limit switches are essentially water temperature and/or pressure controllers, which shut off the gas valve or otherwise turn off the operation of a water or steam boiler, used for hot water or heat. A limit switch is typically an electromechanical device that consists of an actuator mechanically linked to a set of contacts. When an object comes into contact with the actuator, the device operates the contacts to make or break an electrical connection. The boiler temperature control usually has an adjustable temperature sensing for limit control to address different applications. The limit switch can be made to open on temperature rise and/or open or close on temperature fall. For example, a Single Acting Boiler Temperature Control will incorporate a high limit function that acts like an on/off switch. The high limit setting is the maximum temperature the boiler can attain. When the high limit point is reached, the switch turns off the burner. There are numerous other types of limit switches, having double limit controls, differential controls, and the like, but the system, device and method of the present invention works with all types of limit switches equally well, without regard to the actual limiting method used.

Additionally, no device of method exists to improve the safety of sewerage and water drainage systems, which have a similar problem. If left unattended, such systems may cause water and sewage spills, such as in cases of sewer backup, which not only creates a water and/or sewage spill, causing damage, but is also unsanitary and potentially dangerous because sewage and drainage water may contain dangerous and harmful bacteria and other pathogens hazardous to human health and life. Organic materials in sewage decompose quickly, creating breeding grounds for bacteria and emitting odorous gases, which can also be harmful to people. Sewage poses a serious health risk to any people and animals living in the home, and sewage backups are, therefore, very dangerous. Cleaning up a sewage backup and water in the basement can be dangerous for these reasons, and can expose people to bacterial and other infections if they are not careful, making them sick.

Ordinary back water valves that exist for sewerage and water drainage systems are designed to close if the main sewer backs up. However, if the user is unaware of the problem, the water and waste will continue to be flushed into the line, creating a flood of sewage because there is no warning or alarm. Such back water valves often fail in the closed position, leaving the sewer line blocked off even if there is no stoppage, and for this reason such valves are not permitted in many jurisdictions.

What is needed is a system, device and method that can be used in residential and commercial boiler and heating systems, improving the safety of these system by shutting them down if the pressure relief valve is leaking and notifying the owner of the problem, including in boilers and hot water heaters and sewerage and water drainage systems.

The present invention solves this problem by providing a system, device and method for disconnecting the gas valve or the burner and notifying the owner of the leak, caused by excessive pressure or temperature of the heating system or boiler, or alternatively shutting off water to stop the sewage or drainage water backup and alerting the owner of the backup of the sewerage or drainage system.

SUMMARY OF THE INVENTION

It is an object of the present invention to provide a system, device and method to improve the safety of heating systems and boilers, as well as sewerage and drainage system. The present invention (Overflow Preventer) is an inexpensive to manufacture, easy to install, commercial and residential safety device for heating systems and boilers burning natural gas and liquid/solid fuels (i.e., all combustible gases and liquids), and for sewerage and drainage system. The present invention may be used for applications of varying scope, such as a single residential boiler (small) to industrial applications such as a building or factory heating system (large), and from individual house sewerage and water drainage system to a commercial installation.

The preferred embodiment of the present invention achieves this goal with a system, device and method that includes at least one hollow pipe, with one plugged end and a fitting on the opposite end for connecting the pipe to the pressure relief valve, and at least one water-activated switch, disposed inside the hollow pipe. This water-activated switch is preferably a float switch, but it may be an air pressure switch activated when sufficient pressure builds up inside the device after the water accumulates. The pipe is preferably mounted in a substantially vertical configuration and is adopted to be filled with water from leaking pressure relief valve, so that the switch is activated when the pipe fills with water and shuts off the heating system or boiler by being wired in series with a limit switch of the heating system or boiler. Additionally, the same water-activated switch may activate the visual and/or audible alarm for the owner that there is an issue. Alternatively, there may be two separate switches disposed in the hollow pipe, one activating the alarm for the owner and one deactivating the heating system or boiler.

During the operation of a Hot Water Generator (also called a hot water boiler), a steam boiler or a hot water tank, if the pressure exceeds the rated relief pressure of the pressure relief valve (or the working pressure of the system) the spillage will enter the Overflow Preventer. As soon as the Overflow Preventer senses the spilled water (by the float switch) from a hot water boiler or hot water tank, or the condensed water from the steam exiting the pressure relief valve on a steam boiler, the Overflow Preventer shuts the Hot Water Generator down to prevent further pressure build up that may present a danger to life and/or property, and to prevent the massive water spill that will result if the system continues to run unchecked.

Also, the city water supply to the unit may be shut off by the solenoid valve in addition to shutting down the Hot Water Generator. The solenoid valve is located remotely from, but is electrically wired into the system and device of the present invention. On a steam system, a stand-alone or redundant Overflow Preventer may be configured high enough on the return line in order to stop inadvertent overfilling of the system.

The general operation of the Overflow Preventer is as follows:

(a) due to over pressurizing or over filling, water from a hot water boiler, hot water tank or from the return line on a steam system, or condensed steam (water) from the pressure relief valve on a steam boiler, enters the Overflow Preventer;

(b) in the Overflow Preventer, the float rises to close the float switch;

(c) when the float switch closes, the relay coil is energized;

(d) when the relay is energized, the normally closed pair of contacts, that are in series with the limits in the case of a boiler and in series with the flame sensor (thermocouple) in the case of a hot water tank, open to shut the boiler or tank down;

(e) at the same time that the normally closed pair of contacts open, the normally open pair of contacts close to activate the solenoid valve and/or alarm and/or lamp;

(f) when the solenoid valve is activated, it closes the feeder line to the boiler or the cold water supply on the hot water tank; and (g) once the system had been inspected and repaired, the overflow preventer resets after the water that was trapped inside it to raise the float, had been drained.

The air vent allows for full water flow throughout the respective water ways in the overflow preventer and on the tapped return line on a steam system. The relay, which houses the coil, normally closed and normally open contacts and the electrical terminals for the internal factory connections are located on the printed circuit board. The junction block, on the outside of the overflow preventer, provides the terminals for the external field wiring.

This design of the preferred embodiment is simple and elegant, having a compact size and being inexpensive to manufacture and simple to install, providing maximum safety and economic benefit for a minimal investment of labor and materials. The system and device are easy to assemble, and the method is easy to follow according to the disclosure of the present application. No special skills are required, so this invention is usable by anyone. The assembly for users can be conducted at the factor assembling the heating system or boiler, or at the location the heating system or boiler is installed, at any time before or during the exploitation.

Many configurations may be used for the system, device and method of the present invention within the spirit and scope of the present invention. Although the examples and the preferred embodiments are shown primarily with natural gas boilers and heating systems, as well as with sewerage and water drainage system, the system, device and method of the present invention are equally applicable to liquid and solid fuels (combustible liquids and solids) and other application where fluid backup or overflow may be an issue. The anticipated service life of the embodiments of the present invention is at least five years.

BRIEF DESCRIPTION OF THE DRAWINGS

A system, device and method to improve the safety of natural gas burning heating systems, boilers and steam boilers, and sewerage and water drainage system of the present invention will now be described by way of example with reference to the accompanying drawings in which.

DESCRIPTION OF THE PREFERRED EMBODIMENT

Figure 2:
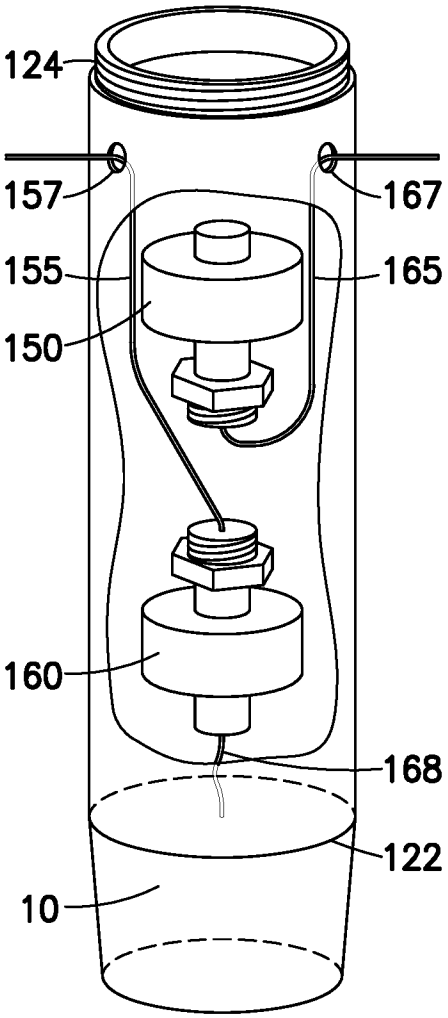
FIG. 2 is a perspective view of the device of FIG. with a hollow pipe, having a fitting or threading on the top end and a closed or plugged bottom end for the accumulation of water from the pressure relief valve and the activation of two float switches positioned in the hollow pipe, where the bottom end of the hollow pipe is plugged by the alarm module.

Boiler pressure relief valve (commonly called blow off valve) is a safety valve that protects the heating system or a boiler from building up to much pressure and possibly blowing up. Sometimes the relief valve or blow off valve will leak. The leaks may be called by a number of reasons, two of which are excessive water pressure or excessive operating temperature, generating steam and, once again, excessive pressure on the system.

The boiler pressure typically varies from 12 psi to 18 psi (12 psi for a boiler and 15 psi for a steam boiler for example). The temperature should typically be between 160 and 180 degrees F. The pressure relief valve for a regular water boiler is set to only allow 12 psi in the boiler. If this valve fails, it will allow the pressure in the boiler to reach 30 psi or higher, causing the relief valve to leak. If the pressure goes over 30 psi and the relief valve does not leak, it may cause a very dangerous situation from overpressure, such as an exploding boiler, exploding pipes, blown off water expansion tank, or blown off relief valve (separated from the boiler). Needless to say, either of these could be hazardous to life and health of any individual in the immediate vicinity due to the explosion and hot water, and it could cause severe water damage from the leaking water.

Temperatures of the heating system or boiler that elevates above the safe operating temperature can also cause the buildup of steam and pressure and an explosion or water leak. The standard recommendation when a pressure relief valve is leaking is to turn off the boiler and to call a specialist to address the problem. However, the owner of the heating system of boiler must be aware of the problem and must be present to do so. If the owner does not see or hear the leaking pressure relief valve somewhere in the basement, or if the owner is simply not home when this happens, the results can be disastrous. The system, device and method of the present invention address these issues of notifying the owner of the problem, as well as improve the general safety of the heating and boiler systems.

Pressure relief valves come in a number of standard sizes known in the art, such as ¾" and ½" valves. The system, device, and method of the present invention can be adopted by those skilled in the art to accommodate all sizes of the pressure relief valves. The pressure relief valves are typically made from bronze, cast iron, stainless steel, and other corrosion-resistant metals that can withstand the specified pressure. The pressure relief valves usually have threading on the ends so that additional pipes may be connected by cooperating male-female connectors.

Figure 1:
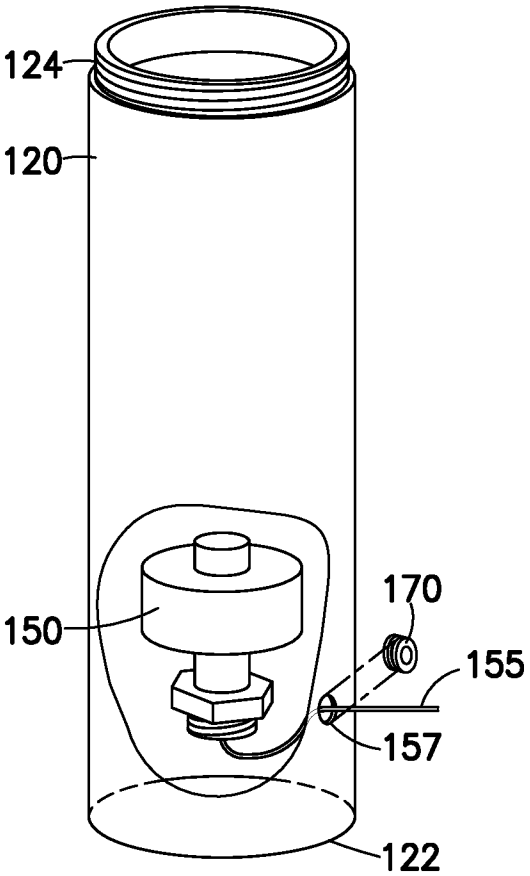
FIG. 1 is a perspective view of the device to improve the safety of heating systems, boilers and steam boilers of the present invention with a hollow pipe, having a fitting or threading on the top end and a closed or plugged bottom end for the accumulation of water from the pressure relief valve and the activation of a float switch positioned in the hollow pipe.

A novel system, device and method to improve the safety of natural gas burning boilers and steam boilers are provided. With reference to FIGS. 1-2, one preferred embodiment of the present invention achieves this goal with a housing in the form of a hollow pipe 120, which is designed for substantially vertical mounting and has a bottom end 122, which is capped or plugged (i.e., does not let water through) or substantially closed (i.e., allow some water through but permits the accumulation of water in the hollow pipe 120), and an open or substantially open top end 124 which is treaded for attaching the housing to the pressure relief valve of a boiler. The hollow pipe 120 is preferably made of copper or other suitable, corrosion-resistant material such as those disclosed herein, and the preferred diameter hollow pipe 120 is one inch (1"), but it could be ¾" to match the standard diameter of the pressure relief valves. Alternatively, the hollow pipe 120 may be 1" but use a ¾" adaptor to connect to the pressure relief valve. It should be noted that although a hollow pipe 120 is the preferred shape of the housing, the housing may be of any other shape or size with an internal cavity. Other attachment means known in the art may be used to connect the open top end 124 to the pressure relief valve of a boiler, including collars, nuts and bolts, screws, pins, clamps, reciprocal connectors, and other methods known in the art.

There is at least one float switch 150 disposed, positioned or mounted inside the hollow pipe 120. The height of the mounting of the float switch 150 inside the hollow pipe 120 determines how early the switch is activated. Although the float switch 150 may be permanently or semi-permanently mounted, it is preferably mounted in a semi-permanent (detachable) way, so that the float switch 150 may be easily replaced. Additionally, the position of the float switch 150 inside the hollow pipe 120 may be adjustable, so that the user or the installer may vary how soon the switch is activated by selectively installing the float switch 150 higher or lower inside the hollow pipe 120.

The float switch 150 is electrically connected to one of the limit switches of the boiler, as illustrated in FIG. 1, such as by water-resistant or waterproof electrical wiring 155 that passes through an aperture 157 in the hollow pipe 120 to reach the limit switch circuit. It should be noted that the aperture 157 should be positioned above the float switch 150 to ensure that the water does not leak out or drip before reaching the float switch 150, as illustrated in FIG. 2, or alternatively, the aperture 157 may be sealed by a sealant such as silicone or other sealants known in the art, or the electrical wiring 155 may pass through a rubber or silicone grommet 170 of a cooperating size with the aperture 157 as illustrated in FIG. 1, so that the aperture 157 is sufficiently water-tight.

Figure 8:
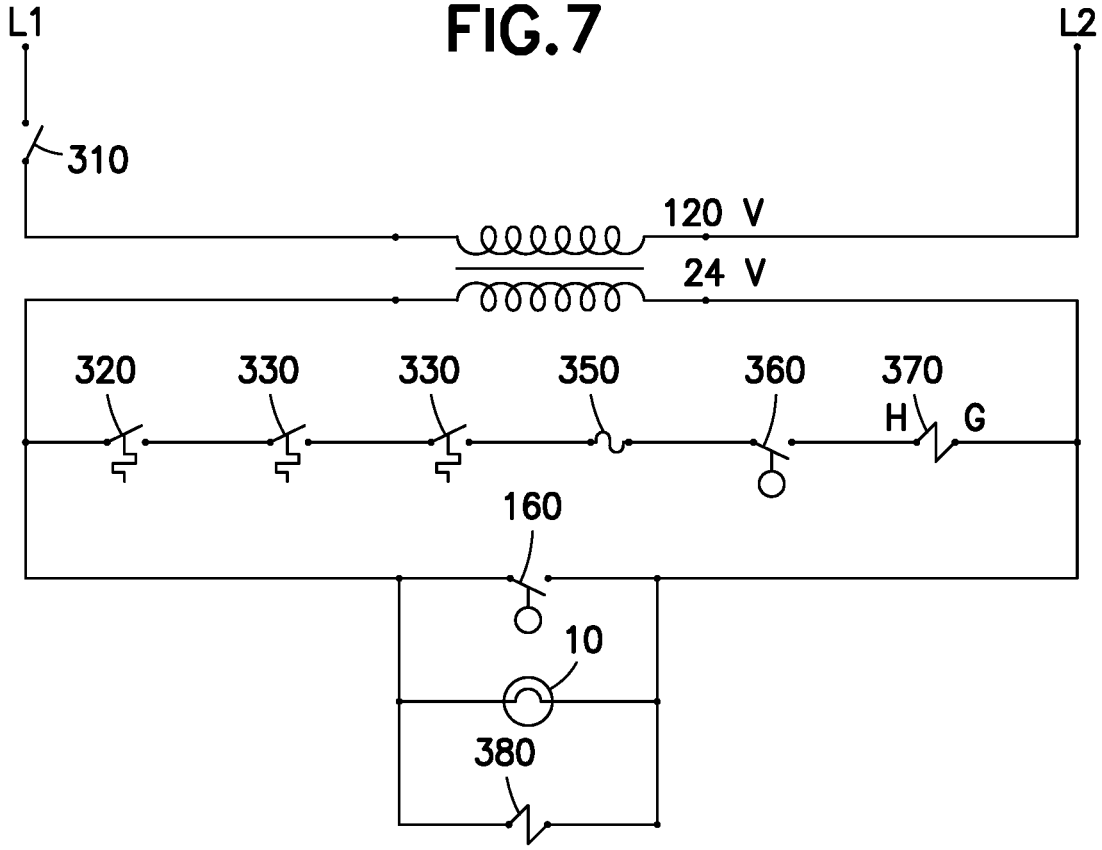
FIG. 8 is a circuit diagram if the electrical circuit of the device and system of the present invention.
Figure 11:
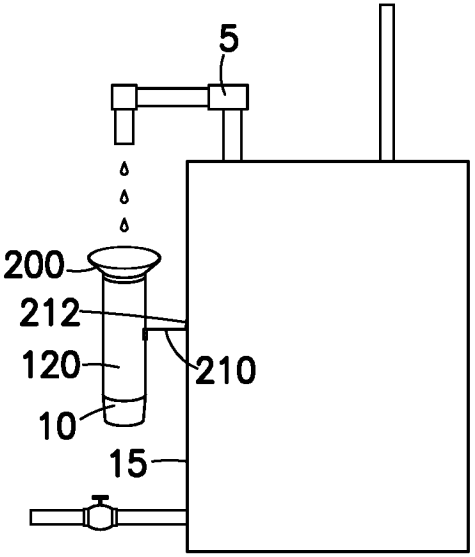
FIG. 11 is a side view of the mounting of the alternative embodiment of the present invention illustrated in FIG. 5.
Figure 10:
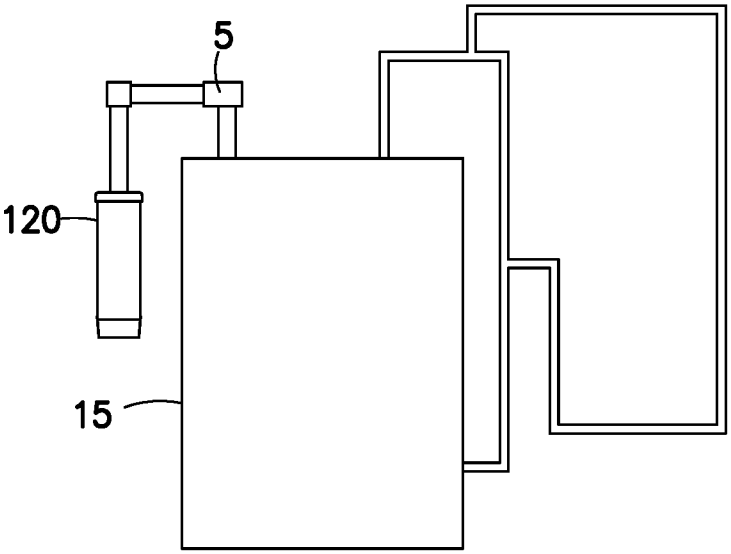
FIG. 10 is a side view of the attachment of the device of FIG. 2 to a pressure relief valve mounted on top of the steam boiler.
Figure 9:
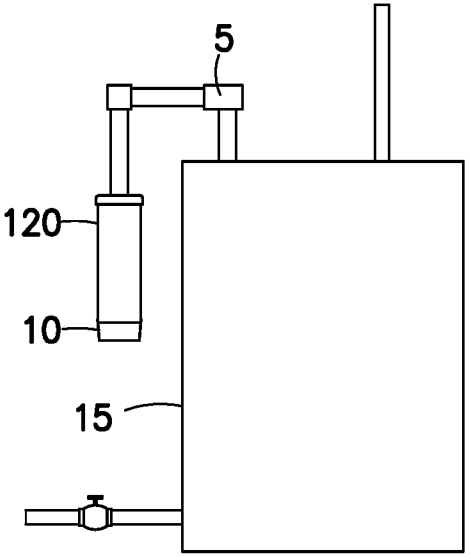
FIG. 9 is a side view of the attachment of the device of FIG. 1 to a pressure relief valve mounted on top of the boiler.
Figure 13:
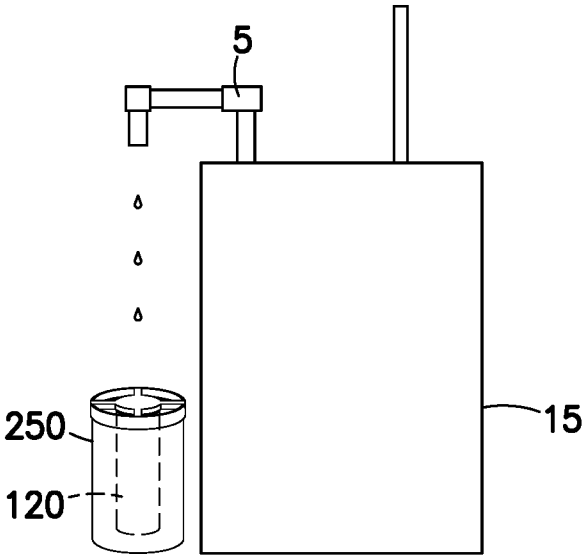
FIG. 13 is a side view of the positioning of the system and device of the present invention illustrated in FIG. 6.

In operation, the open top end 124 is threaded into the pressure relief valve 5 as illustrated in FIGS. 9-10 so that the hollow pipe 120 is substantially vertical. The water leaking or dripping from the pressure relief valve 5 will eventually reach the level of the float switch 150, which will activate and open or close the electrical circuit of the limit switch and thus will shut off the boiler 15 (preferably by shutting off the gas valve solenoid 370 or 380 illustrated in FIG. 8) when the water level reaches the float switch 150 and activates it. Thus, the user or the installer may vary the amount of water that leaks or drips from the pressure relief valve 5 before the float switch 150 is activated and the boiler is shut off. Various mounting means for the float switch 150 are envisioned, such as threading, rails, screws, bolts, pins, and other connectors known in the art.

Figure 3:
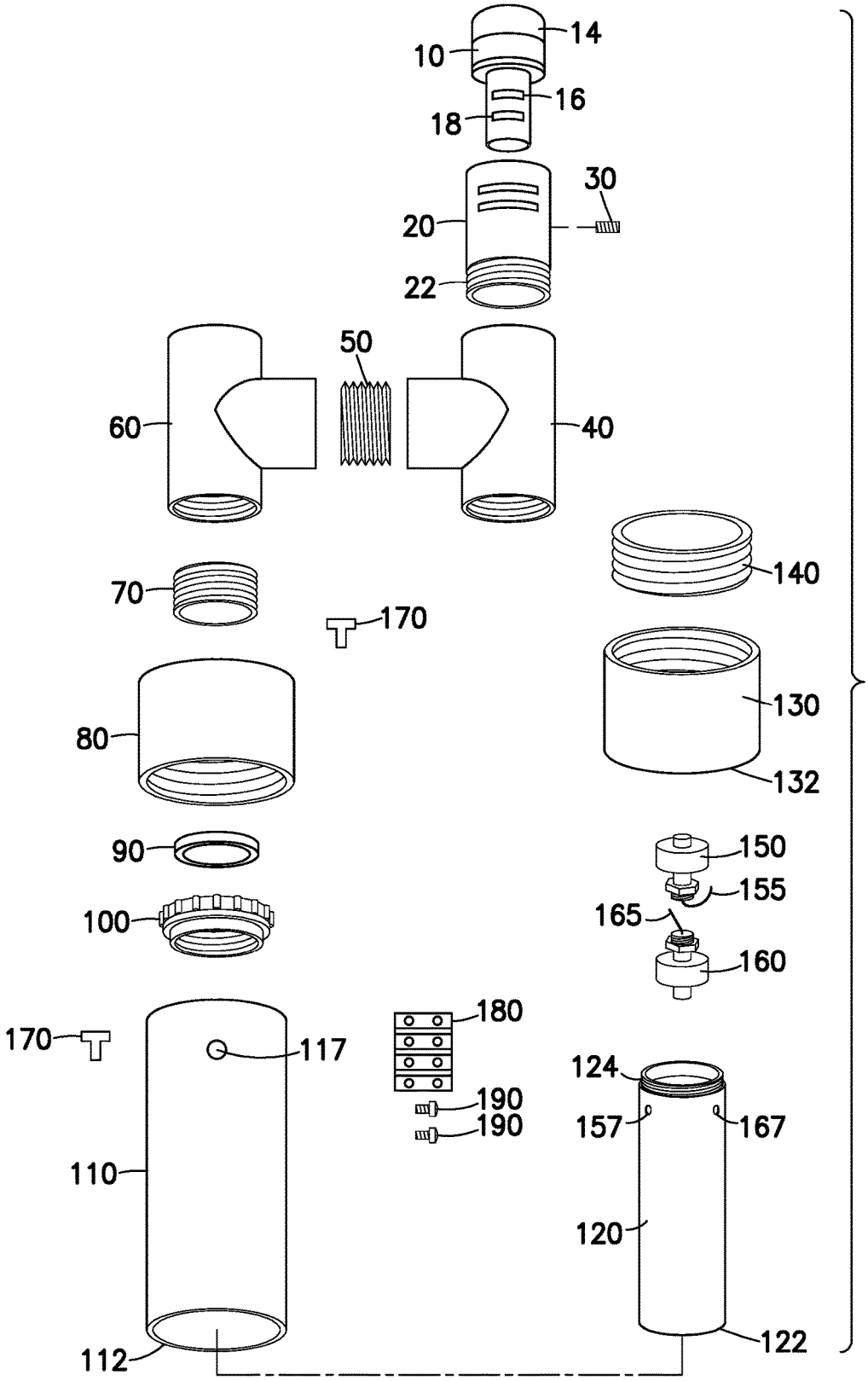
FIG. 3 is a perspective exploded view of an alternative embodiment of the system of the present invention, including a hollow pipe in a housing with a closed bottom end for the accumulation of water from the pressure relief valve and the activation of float switches positioned in the hollow pipe, and an alarm module held in the alarm module housing connected by tees and other parts to complete the system.
Figure 4:
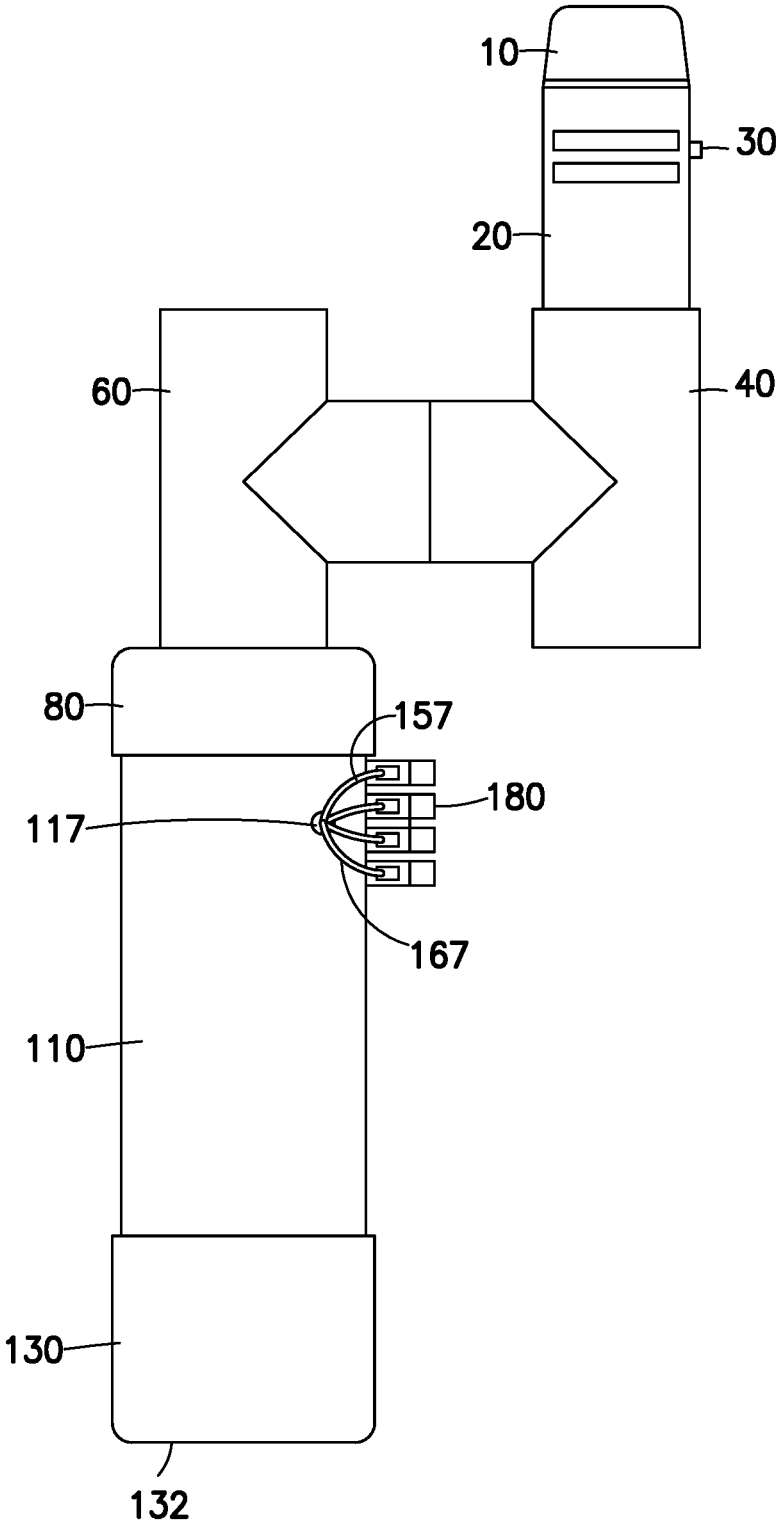
FIG. 4 is a side view of the fully assembled alternative embodiment illustrated in FIG. 3.
Figure 7:
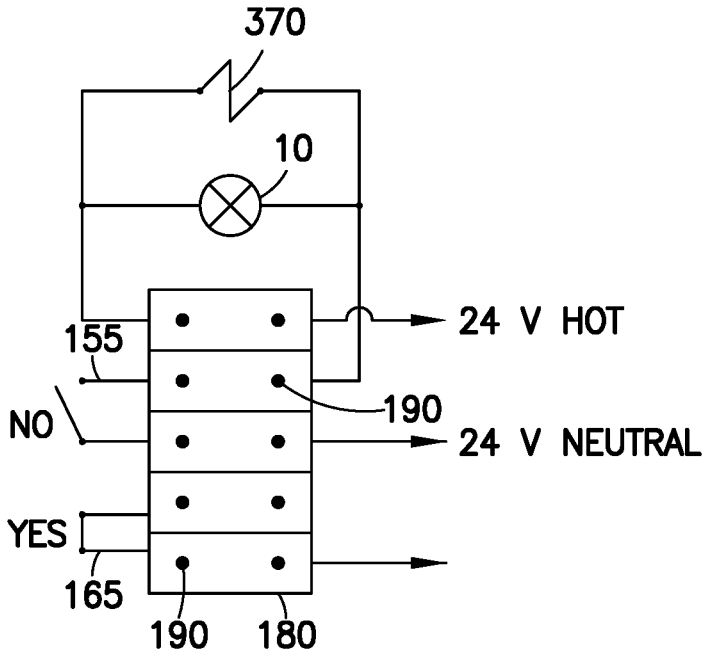
FIG. 7 is a circuit diagram view of the terminal block connecting the electrical wiring from the float switches to limit switches.

In another modification of this preferred embodiment illustrated in FIG. 2, there are two float switches 150 and 160 disposed inside the hollow pipe 120. The float switches 150 and 160 are electrically connected to one of the limit switches of the boiler, as illustrated in FIG. 2, such as by water-resistant or waterproof electrical wiring 155 and 165. The electrical wiring passes through apertures 157 and 167 in the hollow pipe 120 respectively, but, of course, a single aperture (for example aperture 157) may be used for both sets of electrical wiring 155 and 165. In operation, the bottom float switch 160 may give an early visual and/or audible warning to the operator or owner of the boiler by being electrically connected to the alarm module 10 through electrical wiring 168 (direct connection). Alternatively, the alarm module 10 may be connected to the float switch 160 through the terminal block 180 as illustrated in FIGS. 7-8. The alarm module 10 preferably contains an audio alarm or buzzer and a lamp or light warning signal as illustrated in FIGS. 3-4, but can contain just one of those devices. The alarm module may be detachably or permanently mounted into the bottom end 122 of the hollow pipe 120 by threaded or other connectors (essentially, the alarm module 10 then becomes the plug of the bottom end 122, which prevents the water from leaking out from the hollow pipe 120). Then, if the audio and/or visual warning activated by the float switch 160 is not heard or heeded, the float switch 150 deactivates the boiler when the water level rises above the float switch 160 and to the float switch 150, by opening or closing the electrical circuit the limit switch that shuts off the gas valve. The alarm module 10 may have an internal power source, such as a battery, or it may be externally powered by electrical wiring.

Another preferred embodiment of the present invention is shown in FIGS. 3-4, which are the exploded and fully assembled views of this embodiment respectively. With reference to FIG. 3, the system and device of the present invention are made from a hollow pipe 120, which is designed for substantially vertical mounting and has a bottom end 122, and an open top end 124. The hollow pipe 120 is preferably made of copper or other suitable, corrosion-resistant material such as those disclosed herein, and the preferred diameter hollow pipe 120 is one inch (1") or 1½". The bottom end 122 does not need to be capped or plugged in this embodiment because the hollow pipe 120 is housed inside a housing 110, which may be made from Chlorinated Polyvinyl Chloride (CPVC), stainless steel, cast iron, copper or any other suitable material as disclosed herein. The diameter of the housing 110 is preferably 1½", but at least sufficient to accommodate the diameter and length of the hollow pipe 120 and the easy insertion and removal of the hollow pipe 120 into the housing 110. The housing 110 has the bottom end 112, which is capped with a female adapter 130, having a closed or plugged bottom end 132. The female adapter 130 is connected to the bottom end 112 of the housing 110 by the close nipple 140. The capped female adapter 130 ensures that the water leaking or dripping from the pressure relief valve accumulates inside the housing 110, filling the hollow pipe 120 and triggering the float switches 150 and 160. The female adapter 130 and the close nipple 140 are preferably CPVC, and both are preferably of 1½" in diameter.

The float switches 150 and 160 are connected to the limit switch and/or the alarm module 10 by electrical wiring 155 and 165 respectively, which passes through apertures 157 and 167 in the hollow pipe 120 respectively and come out of the aperture 117 in the housing 110. The wiring 155 and 165 is connected to the terminal block 180, which uses terminal block screws 190 to secure, connect and disconnect the wiring. The electrical connections to and from the terminal block 180 are illustrated in FIG. 7, where a water valve shutoff solenoid 370 is connected in series with the float switch 150 and connected in parallel with the alarm module 10. The wiring 165 (closed circuit) illustrates that the float switch 160 was activated, but the open circuit of the wiring 155 illustrates that the float switch 150 has not yet been activated, and the electric wiring 175 sends the close the valve command by opening or closing the electrical circuit of the limit switch or switches from the terminal block 180 by electrical wiring 175.

The entire electrical circuit, including limit switch, float switch, alarm, and water valve shut off is illustrated in FIG. 8, where the single-pole, single-throw SPST switch 310 turns on the 120 V power, which is converted to 24 V to power the circuit including a THST 320, an aquastat water temperature controller 330, a blocked vent switch 340, a flame roll out switch 350, a low water cut off switch 360, and a gas valve shutoff solenoid 370 in series with the float switch 150. There may be another float switch 160 connected in parallel with the alarm module 10 and a shut off valve solenoid 380.

The housing 110 is connected to a cap 80, which may be made from the same or a different material than the housing 110 a locknut 100, having a washer 90 between the locknut 100 and the cap 80. The locknut 100 is preferably a ¾" diameter brass, and the washer 90 is preferably rubber, but other suitable materials may be used. the cap is preferably the same diameter and the housing 110 (i.e., 1½"), The cap 80 is connected to an in-line arm of the threaded Tee 60 by the means of a threaded close nipple 70, which is preferably ¾" diameter brass. The threaded Tee 60 is preferably a ¾" diameter CPVC, and the transverse arm of the treaded Tee 60 it is connected to the transverse arm of another threaded Tee 40 by a threaded close nipple 50, which is also preferably ¾" diameter brass. The threaded Tee 40 is also preferably a ¾" diameter CPVC. There is an alarm module housing 20 connected to the threaded Tee 40 by the threaded bottom end 22 of the alarm module housing 20. The alarm module 10 is held in place in the alarm module housing 20 by the set screw 30. The alarm module 10 is electrically connected to one or more of the float switches 150 and 160, and the alarm module contains a light source, such as a lamp, LED, or strobe light 14, and/or a sound transducer 16 such as a speaker, piezo buzzer, or another type of audible alarm. The alarm module may also contain electrical, electronic, and/or communications circuitry 18 to communicate with the owner of the operator of the boiler that the water is leaking from the pressure relief valve when one or more of the float switches 150 and 160 are activated. The communications may be by connecting into the home network or Wi-Fi wireless signal, or by initiating a landline or cellular telephone call, email or text message.

The terminal block 180 is preferably attached to the housing 110 as illustrated in FIG. 4, which shows the fully-assembled embodiment of FIG. 3. As shown in FIG. 4, the system and device of the present invention connect to the pressure relief valve by the threaded connector in one of the in-line arms of this threaded Tee 60. The opposite in-line arm of the threaded Tee 60 is connected to the pressure relief valve of a boiler, preferably by using cooperating threading or other connection means. The threaded Tee 40 connected to the threaded Tee 60, the alarm module housing 20 and the alarm module 10 held by the set screw 30 are on a separate "branch" of the system and device, so they are not affected by the water leaking or dripping from the release valve into the threaded Tee 60, through the cap 80, and into the housing 110, where the water accumulates because the female adapter 130 caps the housing 110. The water fills the housing 110 and the hollow pipe 120, and triggers the float switches 150 and 160 illustrated in FIG. 3. The wiring 157 and 167, passing through the aperture 117 in the housing 110 enables the float switches 150 and 160 to open or close the electrical circuits of the limit switch or switches on the boiler.

Figure 12:
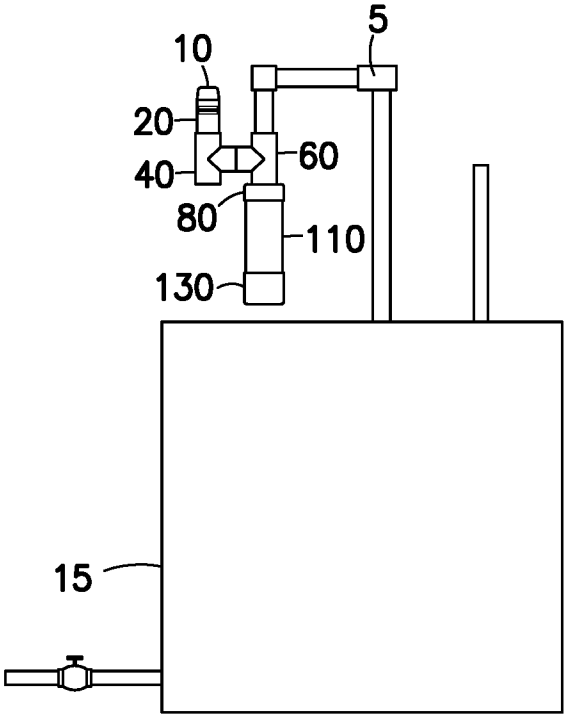
FIG. 12 is a side view of the mounting of the system and device of the present invention illustrated in FIGS. 3-4.

The particular embodiment illustrated in FIG. 3 is especially useful when it is necessary to clear the top of the boiler. As illustrated in FIG. 12, the pressure relief valve 5 is usually mounted on the top of the boiler 15. The connections of two Tees described with reference to FIG. 3 allows to mount the device and system of the present invention to the pressure relief valve, while avoiding interference from the top of the system and device (i.e., the alarm housing 20 and the alarm module 10 are on a separate branch, parallel to the main device, so they do not take up any vertical space). In this configuration, the housing 110 with the hollow pipe 120 and the float switches 150 and 160 would be suspended in the above the top of the boiler 15.

For occasions when various codes, such as city plumbing codes or local ordinances, do not permit attaching the system and device of the present invention directly to the pressure relief valve (for example, when it is prohibited to restrict or obstruct the water flow from the pressure relief valve), several other embodiments of the present invention are provided.

Figure 5:
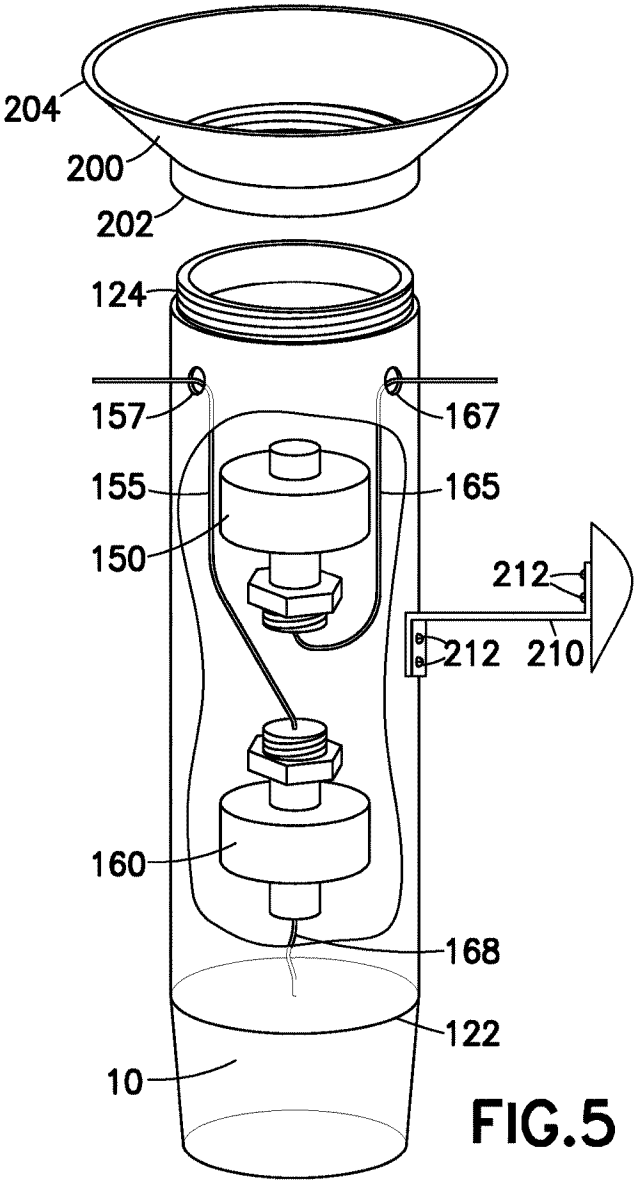
FIG. 5 is a perspective view of another alternative embodiment of the device of FIG. 1, also including a funnel for collecting water from the pressure relief valve and directing the water into the hollow pipe where the float switches are located, and also including a bracket for mounting the hollow pipe to the wall of the boiler.

One such embodiment is illustrated in FIG. 5. With reference to FIG. 5, the embodiment is as described herein with reference to FIGS. 1-2, but also including a funnel 200 having a wide top end 204 and a narrow bottom end 202, cooperating in size with the top end 124 of the hollow pipe 120, so that the funnel 200 may be used in conjunction with the hollow pipe 120. The narrow bottom end 202 of the funnel 200 is preferably threaded as a female threaded connector, to accept the male threaded top end 124 of the hollow pipe 120 (i.e., both the top end 124 and narrow bottom end 202 would have cooperating male/female threading, preferably of a standard ¾" or ½" size. This embodiment would also include a bracket 210 with screws or bolts 212, or other mounting means to connect the hollow pipe 120 to the side wall of the boiler. The size of the bracket 210 or other mounting means would be selected (or would be adjustable) to position the hollow pipe 120 substantially under the pressure relief valve during the installation. Thus, in operation, the hollow pipe 120 would have a funnel 200 screwed onto the top end 124 via the narrow bottom end 202, so that the funnel 200 would be collecting the water leaking or dripping from the pressure relief valve and directing the water into the hollow pipe 120 with one or more float switches 150 and/or 160. When the water reached the level of any given float switch, it would be activated, performing its function (i.e., signaling the alarm via a sound and/or visual indicator, contacting the owner/operator of the boiler, and/or shutting off the boiler).

Figure 6:
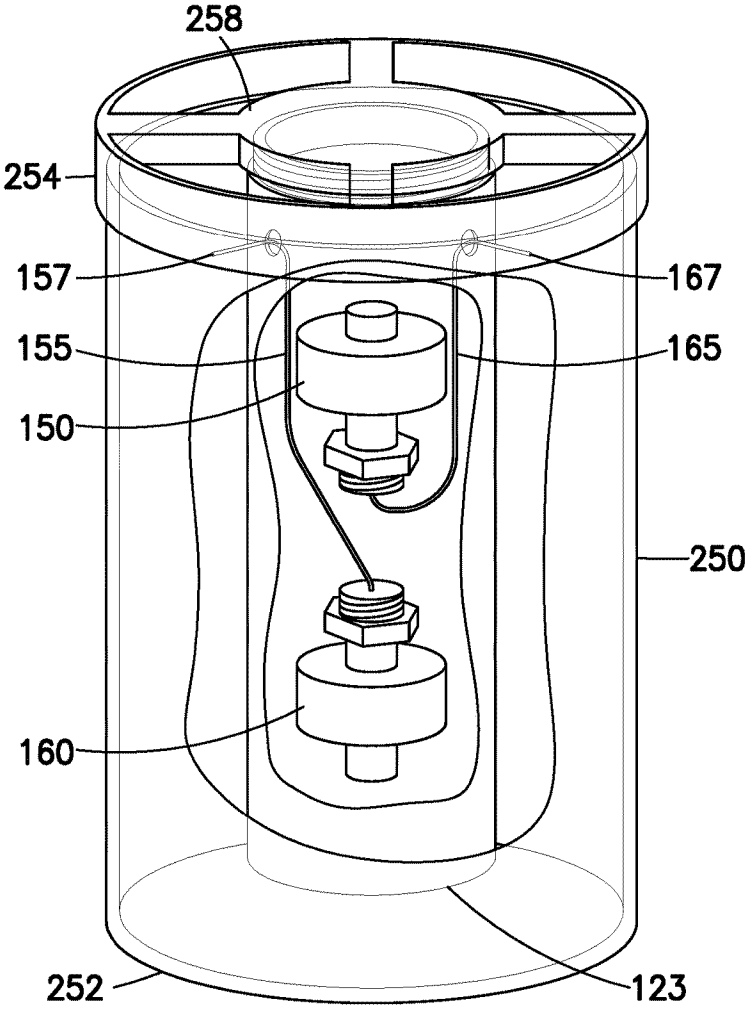
FIG. 6 is a perspective view of yet another alternative embodiment of the device of FIG. 2, also including a container for collecting water from the pressure relief valve and directing the water into the hollow pipe, where the float switches are located.

Yet another embodiment for when the system and device of the present invention cannot be connected directly to the pressure relief valve is illustrated in FIG. 6. With reference to FIG. 6, this embodiment of the present invention has a hollow pipe 120, which is designed for substantially vertical mounting and has an open bottom end 123 (i.e., which is not capped or plugged), and an open top end 124 which is treaded. The hollow pipe 120 is preferably made of copper or other suitable, corrosion-resistant material such as those disclosed herein and has the same preferred diameters as disclosed herein.

There is at least one float switch 150 disposed inside the hollow pipe 120, but preferably there is another float switch 160 as illustrated in FIG. 6. The height of the mounting of the float switch 150 inside the hollow pipe 120 determines how early the switch is activated. Although the float switch 150 may be permanently or semi-permanently mounted, it is preferably mounted in a semi-permanent (detachable) way, so that the float switch 150 may be easily replaced. Additionally, the position of the float switch 150 inside the hollow pipe 120 may be adjustable, so that the user or the installer may vary how soon the switch is activated by selectively installing the float switch 150 higher or lower inside the hollow pipe 120.

The float switch 150 is electrically connected to one of the limit switches of the boiler, as illustrated in FIG. 1, such as by water-resistant or waterproof electrical wiring 155 that passes through an aperture 157 in the hollow pipe 120 to reach the limit switch circuit.

The container 250 preferably has a bottom part 252, which is a regular container of any shape, preferably cylindrical, and a top part 254 that connects or attaches to the bottom part 252. The top part 254 has an attachment means 258 for the threaded top end 124 of the hollow pipe 120, so that the top part 254 may be taken off or disconnected from the bottom part 252, the top end 124 connected to the top part 254 by the attachment means 258, which are preferably reciprocal threading, and the top part 254 is then placed back onto or attached to the bottom part 252 so that the hollow pipe 120 is substantially vertical and disposed inside the container 250. The container 250 may be freestanding or it may be attached to the side wall of the boiler 15 under the pressure relief valve 5. Likewise, the hollow pipe 120 may be attached to or secured in the container 250 by using methods other than the treaded top end 124.

In operation, the container 250 is placed or mounted under the pressure relief valve 5, and the container 250 will collect the water leaking or dripping from the pressure relief valve 5. The water will fill up the container 250 and the hollow pipe 120 through the open bottom end 122 and eventually reach the level of the float switch 150, which will activate and open or close the electrical circuit of the limit switch as illustrated in FIGS. 7-8, and thus will shut off the boiler (preferably by shutting off the gas valve solenoid 370 or 380) when the water level reaches the float switch 150 and activates it. Thus, the user or the installer may vary the amount of water that leaks or drips from the pressure relief valve before the float switch 150 is activated and the boiler is shut off by varying the size of the container (diameter if cylindrical, for example) to vary the volume of water leaked before the float switch 150 is activated. Details and specifics on the size of the parts and material selection will be calculated in case of a specific task (in terms of water flow and volume). Various mounting means for the float switch 150 are envisioned, such as threading, rails, clamps, snaps, metal collars, screws, bolts, pins, crimps, welding and other connectors or connection means known in the art. Any other attachment means known in the art for connecting water pipes may be used for the attachment of the hollow pipe 120, the float switches, and the other elements of the present invention. The container 250 may itself be mounted to the floor or to the wall of the boiler 15 to ensure proper positioning for collecting the leaking or dripping water.

The diameter of the hollow pipe 120 is preferably ¾" or 1", but other sizes may be utilized depending on the desired application. The preferred length of the hollow pipe 120 is between 4" and 6", but the length may be varied depending on the application, the sizes of the float switches and the desired speed with which the heating system or boiler is shut off. In yet another improvement of the system, device, and method of the present invention, a warning light and/or sound is used to alert the owners to the problem with the pressure relief valve, contemporaneously with shutting off the boiler or the heating system. In this embodiment, a light, preferably an LED or fiber optic light, and/or a sound emitter (such as a speaker or piezo- or electric buzzer) are built into the device 10 of the present invention, together with control electronics 18 and wiring 168 to activate them, and an interior or exterior power source to power them, which is preferably a replaceable battery.

The pressure relief valve is typically mounted on top of the boiler tank. The hollow pipe 120 is mounted into the pressure relief valve 5 with a fitting on one end of the hollow pipe 120 or a threaded top end 124 as illustrated in FIGS. 9-10. If the pressure relief valve 5 and the hollow pipe 120 are directly above the top of the water boiler 15 and there is not sufficient space to clear the top, an adaptor can be used (additional pipes, elbows and/or and bends) to connect the hollow pipe 120 to the pressure relief valve 5, such as the connection illustrated in FIG. 12.

The hollow pipe 120 is preferably made of copper, where the cross-section of the hollow pipe 120 is preferably substantially the same along its entire length. However, the hollow pipe 120 may be made from stainless steel, cast iron, brass, and other materials commonly used for gas or water pipes.

Figure 14:
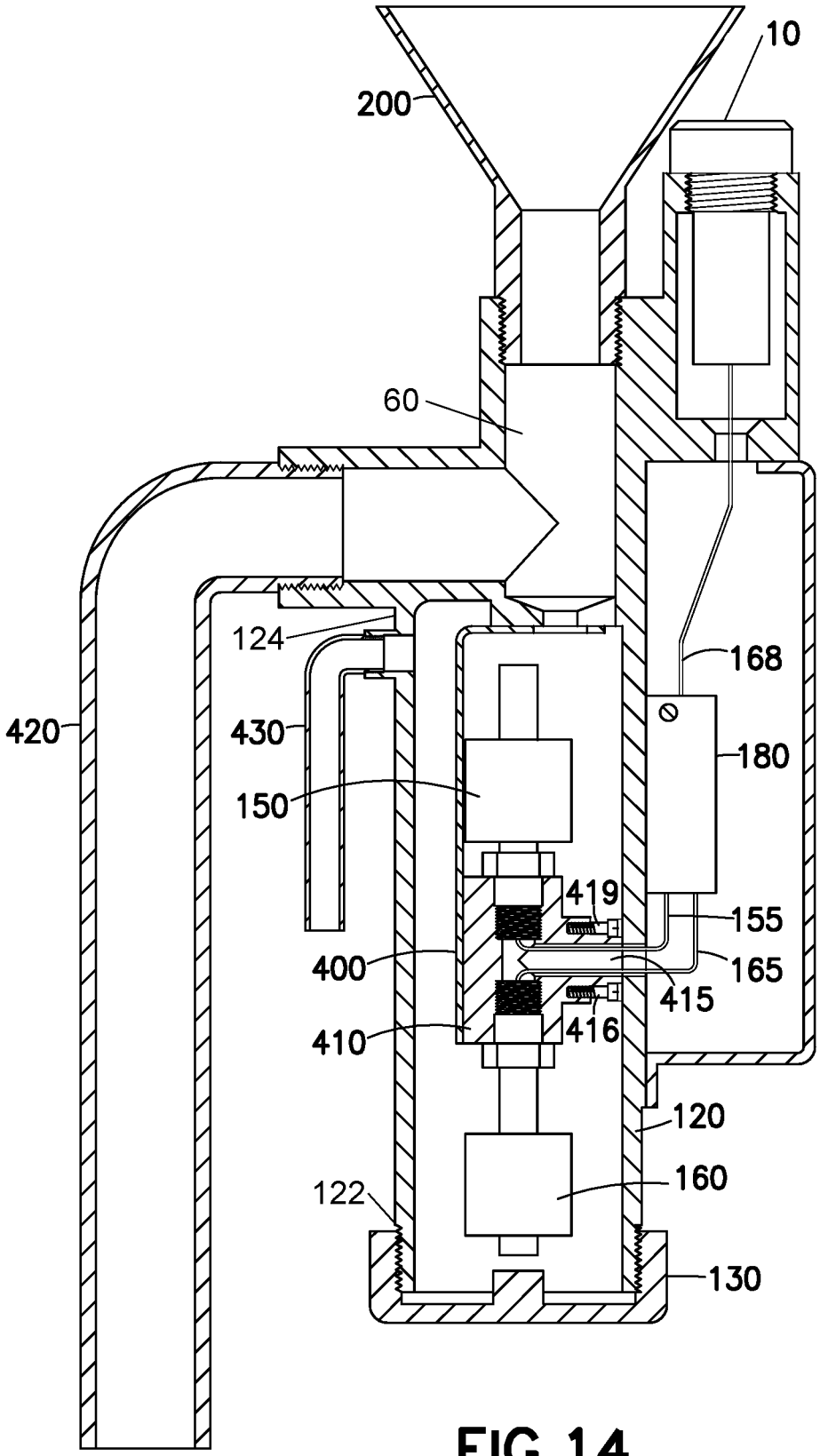
FIG. 14 is a side cross-sectional view of one of the preferred embodiments of the system and device of the present invention.
Figure 15:
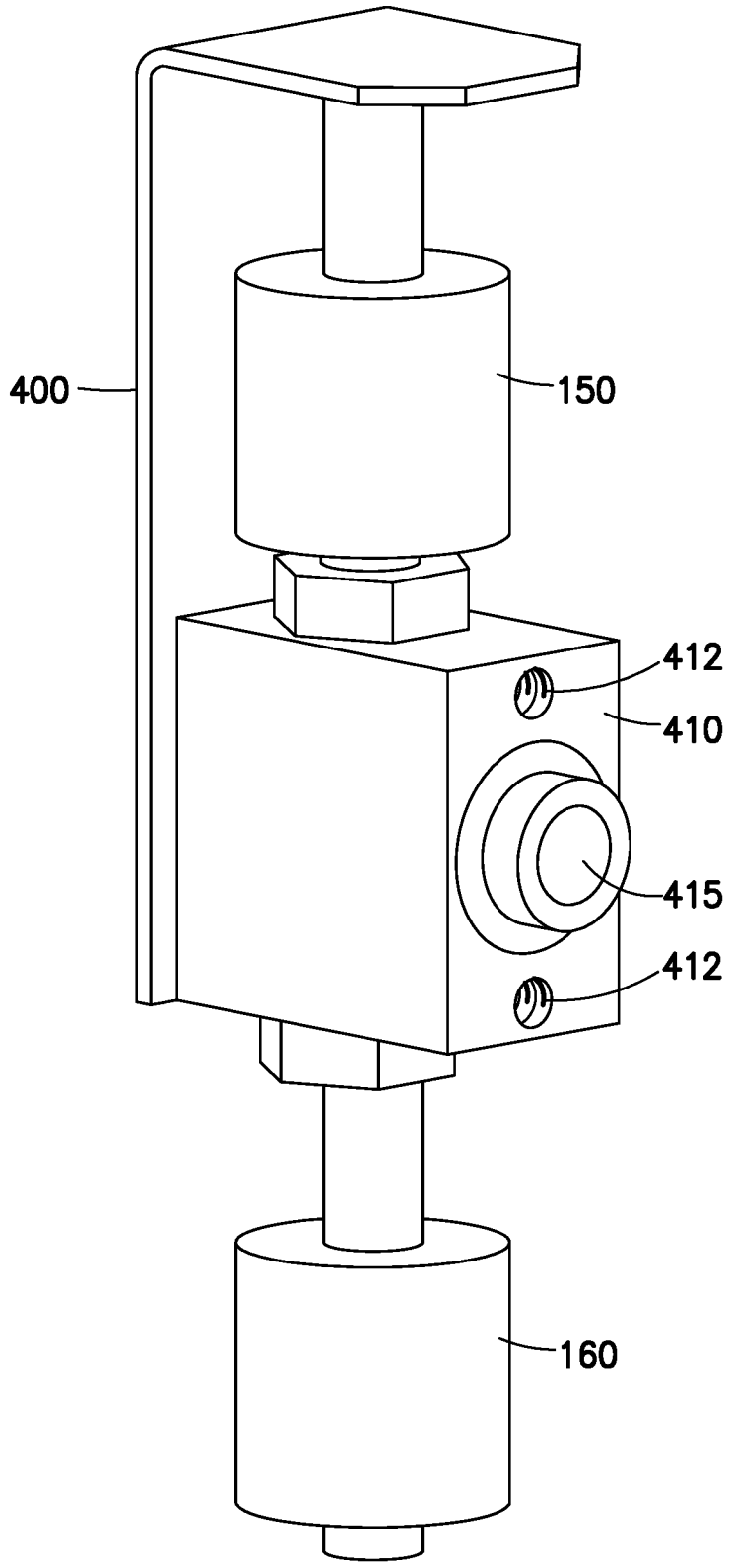
FIG. 15 is an enlarged perspective view of the connector block, protective plate and two connected float switches illustrated in FIG. 14.

With reference to FIGS. 14-15, yet another preferred embodiment of the present invention achieves this goal with a housing in the form of a hollow pipe 120, which is designed for substantially vertical mounting and has a bottom end 122, which is capped or plugged (i.e., does not let water through) or substantially closed (i.e., allow some water through but permits the accumulation of water in the hollow pipe 120), and an open or substantially open top end 124 which is adapted for attaching the housing to the pressure relief valve of a boiler. The hollow pipe 120 is preferably made of copper or other suitable, corrosion-resistant material such as those disclosed herein, and the preferred diameter hollow pipe 120 is one inch (1"), but it could be ¾" to match the standard diameter of the pressure relief valves. Alternatively, the hollow pipe 120 may be 1" but use a ¾" adaptor to connect to the pressure relief valve. It should be noted that although a hollow pipe 120 is the preferred shape of the housing, the housing may be of any other shape or size with an internal cavity. Other attachment means known in the art may be used to connect the open top end 124 to the pressure relief valve of a boiler, including collars, nuts and bolts, screws, pins, clamps, reciprocal connectors, and other methods known in the art.

The bottom end 122 of the hollow pipe 120 is capped with a cap 130 to allow the accumulation of water inside the hollow pipe 120. There may also be a downward-pointed pipe 420 attached to the hollow pipe 120 above the top end 124 to channel excess water away from the device. An additional downward-pointed pipe 430 may be attached to the hollow pipe 120 below the top end 124 to allow the runoff of excess water and/or air from the housing (hollow pipe) 120 itself. Thus, the downward-pointed pipe 430 essentially serves as a water and/or air vent, which can be automatic. Using one or both pipes ensures that no excess pressure builds inside the hollow pipe 120, but still enables sufficient water amounts to be collected for the proper operation of the device.

There is at least one float switch 150 disposed, positioned or mounted inside the hollow pipe 120. The height of the mounting of the float switch 150 inside the hollow pipe 120 determines how early the switch is activated. Although the float switch 150 may be permanently or semi-permanently mounted, it is preferably mounted in a semi-permanent (detachable) way, preferably to the connector block 410, so that the float switch 150 may be easily replaced. The connector block 410 has one or more apertures 412 cooperating in size and positioning with the respective one or more apertures 416 in the hollow pipe 120. For removable mounting, the apertures 412 and 416 are aligned, and the connector block 410 holding the float switch 150 is secured to the hollow pipe 120 by screws 419 of appropriate size. The connector block 410 also preferably has an aperture 415 aligned with the aperture in the hollow pipe 417, through which apertures wiring from the float switch 150 is connected to the terminal block 180. Additionally, the position of the float switch 150 inside the hollow pipe 120 may be adjustable, so that the user or the installer may vary how soon the switch is activated by selectively installing the float switch 150 higher or lower inside the hollow pipe 120. The bracket 210 attached to the hollow pipe 120 secures the device to the wall of a boiler.

The float switch 150 is electrically connected to one of the limit switches of the boiler, as illustrated in FIG. 15, such as by water-resistant or waterproof electrical wiring 155 that passes through apertures 415 in the connector block 410 and 417 in the hollow pipe 120 to connect to the terminal block 180 and from that to reach the limit switch circuit. It should be noted that the runoff pipe 430 should be positioned above the float switch 150 to ensure that the water does not leak out or drip before reaching the float switch 150, as illustrated in FIG. 14. The float switch 150 may be covered by a protective plate 400 to ensure that the float switch 150 is not tripped before sufficient water accumulates in the hollow pipe 120. The protective plate 400 is preferably mounted onto the connector block 410, but it may also be mounted to the hollow pipe 120 or the float switch 150 itself.

In operation, the device should be connected to or positioned under the pressure relief valve 5 (with a funnel 200) the so that the hollow pipe 120 is substantially vertical. The water leaking or dripping from the pressure relief valve 5 will accumulated in the hollow pipe 120 and eventually reach the level of the float switch 150, which will activate and open or close the electrical circuit of the limit switch, and thus will shut off the boiler 15 when the water level reaches the float switch 150 and activates it. Thus, the user or the installer may vary the amount of water that leaks or drips from the pressure relief valve 5 before the float switch 150 is activated and the boiler is shut off.

As illustrated in FIG. 14, there may be two float switches 150 and 160 disposed inside the hollow pipe 120, both connected to the connector block 410. The float switches 150 and 160 are electrically connected to one of the limit switches of the boiler, as illustrated in FIG. 14, such as by water-resistant or waterproof electrical wiring 155 and 165 passing through apertures 415 in the connector block 410 and 417 in the hollow pipe 120 to connect to the terminal block 180. In operation, the bottom float switch 160 may give an early visual and/or audible warning to the operator or owner of the boiler by being electrically connected to the alarm module 10 through electrical wiring through the terminal block 180 as illustrated in FIGS. 14-15. In this and all of the described embodiments, a single float switch 150 with a relay 390 as illustrated in FIGS. 16-17 can perform the same functions as two float switches illustrated in FIGS. 14-15.

Figure 24:
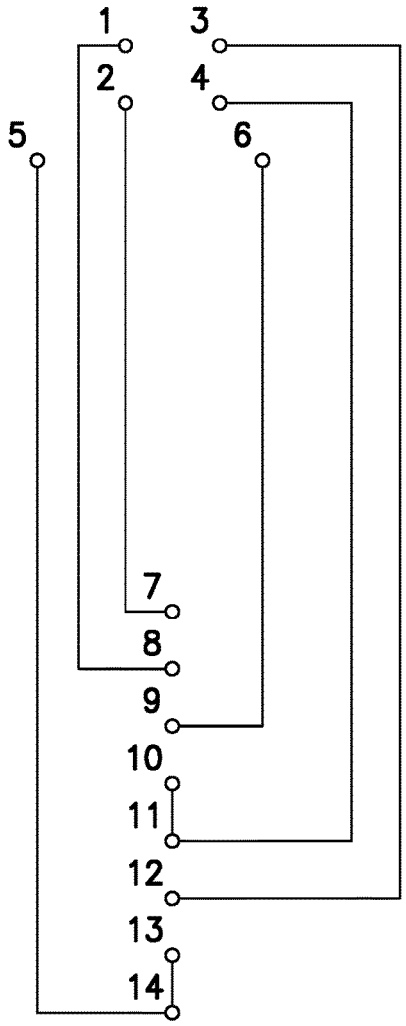
FIG. 24 is an electrical diagram of the printed circuit board and the contacts of an electrical relay of the system and device of the present invention.

The relay can be a single pole single throw or a double pole double throw relay, and the preferred embodiment uses the double pole double throw relay 390 (a single coil-double contact points relay), the printed circuit board and contacts of which are illustrated in FIG. 24. The preferred relay is the double pole double throw relay 390 because it can work with one float switch 150. Note that such a configuration activates the alarm and shuts down the unit/water to the unit at the same time, which will be suitable for most practical uses. However, if it is desirable to provide these functions at different times, two float switches may still be used.

Figure 16:
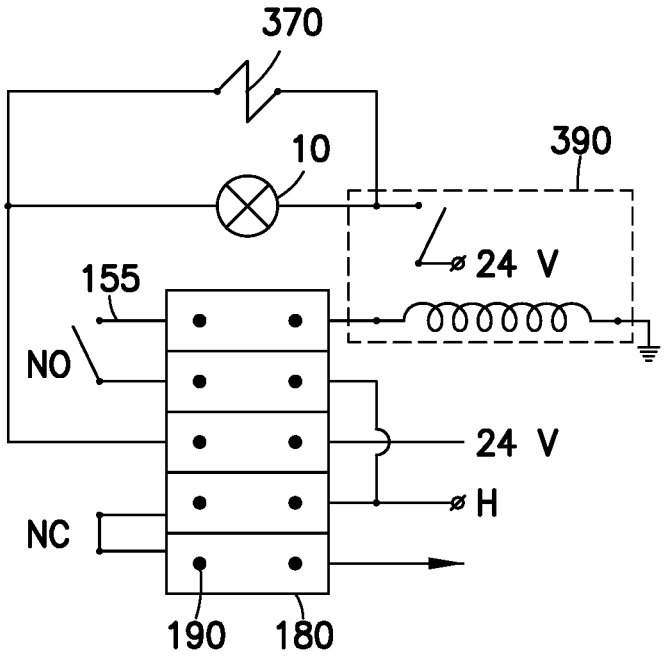
FIG. 16 is an electrical wiring diagram of the preferred embodiment illustrated in FIG. 14.
Figure 17:
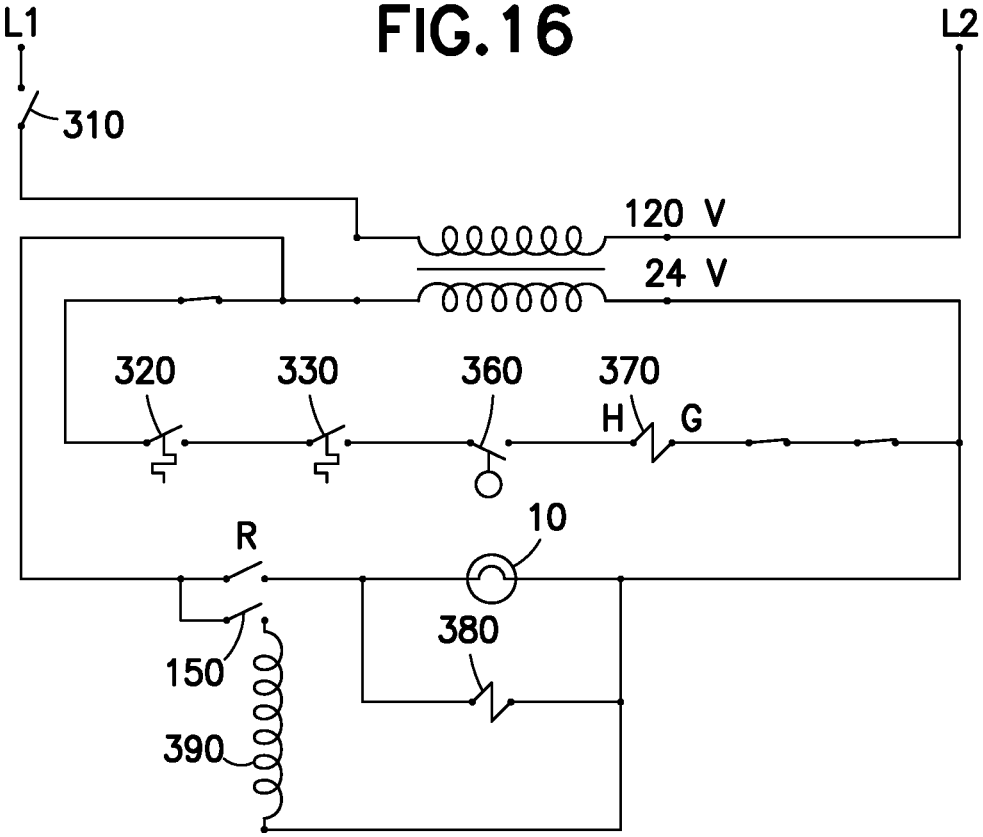
FIG. 17 is another electrical wiring diagram of the preferred embodiment illustrated in FIG. 14.

Specifically with reference to FIGS. 16-17, in operation, the device should be connected to or positioned under the pressure relief valve 5 (with a funnel 200) the so that the hollow pipe 120 is substantially vertical. The water leaking or dripping from the pressure relief valve 5 will accumulated in the hollow pipe 120 and eventually reach the level of the float switch 150, which will activate and open or close the electrical circuit of the limit switch, and thus will shut off the boiler 15 when the water level reaches the float switch 150 and activates it and opens or closes the electrical circuit of the limit switch, and thus will shut off the boiler (preferably by shutting off the gas valve solenoid 370 or 380) when the water level reaches the float switch 150 and activates it.

Figure 18:
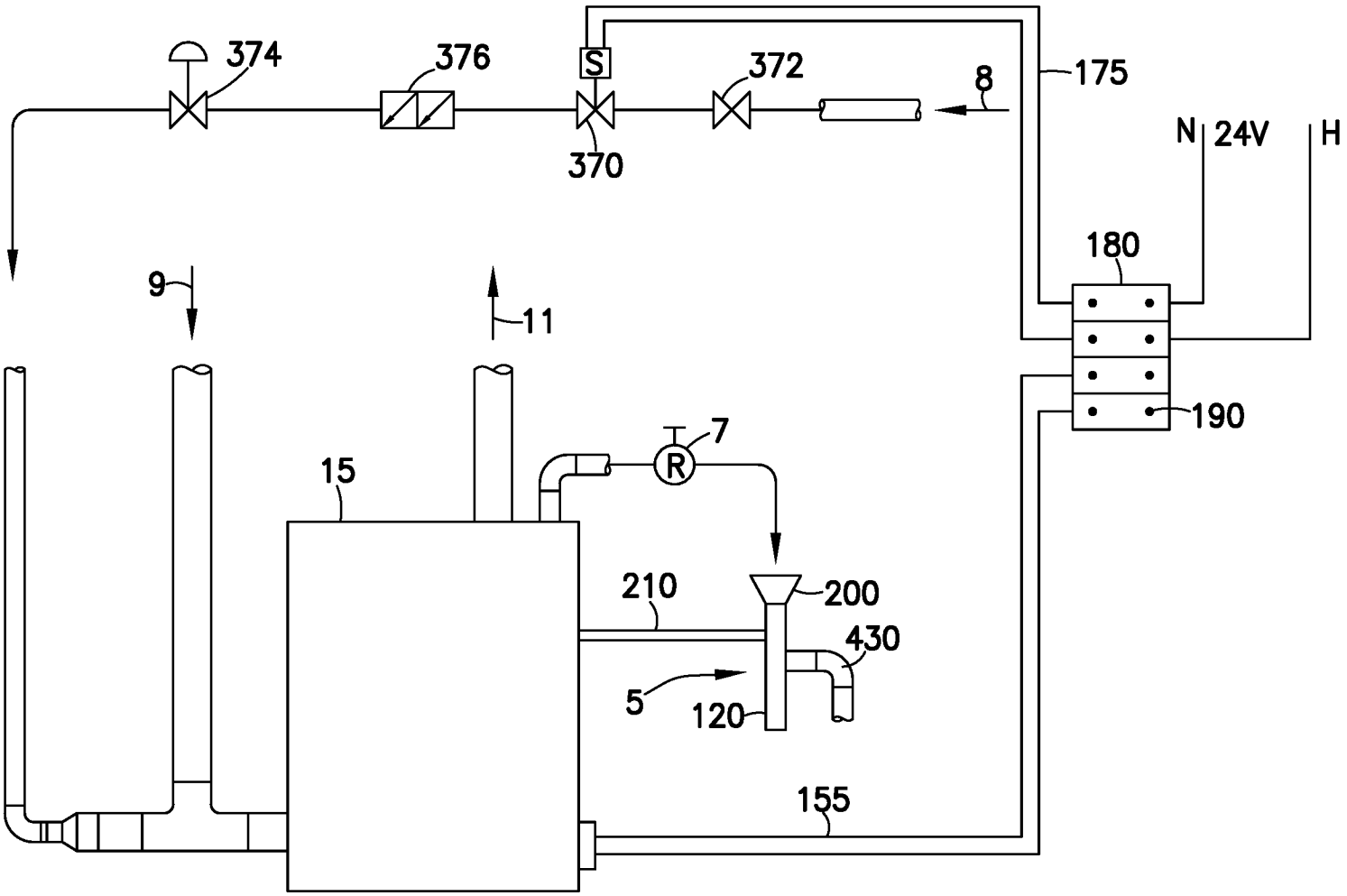
FIG. 18 is a diagram of the system and device of the present invention being used with a hot water boiler.

With reference to FIG. 18, the system and device of the present invention being used with a hot water boiler, the hot water boiler 15 has a city water in pipe 8, a water supply pipe 11, a return pipe 9, a pressure relief valve 7, and electrical wiring 155 (the limits connection) connected to the hot water boiler 15. The system and device of the present invention 5 (Overflow Preventer) is connected to the hot water boiler 15 by a bracket 210. Specifically, the system and device of the present invention 5 include a hollow pipe 120 (housing) with a connected funnel 200 as described in this specification and a downward-pointed pipe 430 connected to the hollow pipe 120. The downward-pointed pipe 430 releases excess water from the hollow pipe 120 to ensure pressure does not build up inside.

The terminal block 180 in the Overflow Preventer is wired to the hot water boiler 15 limits through the electrical wiring 155, is wired to the hot and neutral 24 V power, and is wired to the solenoid valve 370 by the electric wiring 175. The terminal screws 190 on the terminal block 180 are used to connect the electrical wiring. The solenoid valve 370 is also connected to the manual water shut off 372 on the city water in pipe 8, a backflow preventer 376 and a pressure regulating valve 374. The size and length of the bracket 210 are selected so as to enable the system and device of the present invention 5 to be positioned substantially under the water runoff from the pressure relief valve 7. In operation, the funnel 200 collects the water runoff and directs it into the hollow pipe 120, where the water activates a float switch or switches, shutting off the solenoid valve 370.

Figure 19:
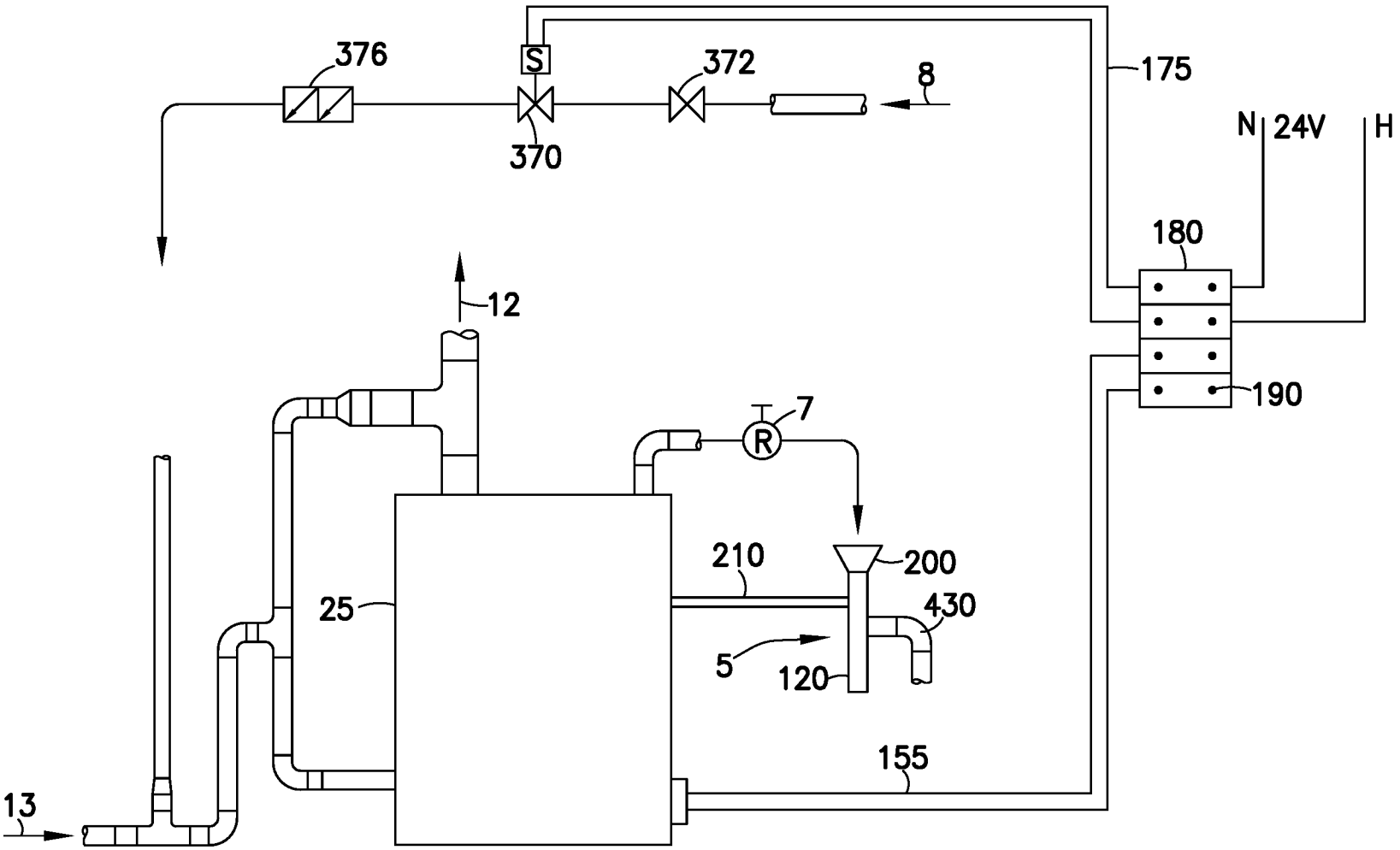
FIG. 19 is a diagram of the system and device of the present invention being used with a steam boiler.

The operation of the system and device 5 of the present invention with a steam boiler is similar. With reference to FIG. 19, the steam boiler 25 has a city water in pipe 8, a steam supply pipe 12, a condensate return pipe 13, a pressure relief valve 7, and electrical wiring 155 (the limits connection) connected to the steam boiler 25. The system and device of the present invention 5 (Overflow Preventer) is connected to the steam boiler 25 by a bracket 210. The system and device of the present invention 5 include a hollow pipe 120 (housing) with a connected funnel 200 as described in this specification and a downward-pointed pipe 430 connected to the hollow pipe 120. The downward-pointed pipe 430 releases excess water from the hollow pipe 120 to ensure pressure does not build up inside.

The terminal block 180 in the Over flow Preventer is wired to the steam boiler 25 limits through the electrical wiring 155, is wired to the hot and neutral 24 V power, and is wired to the solenoid valve 370 by the electric wiring 175. The terminal screws 190 on the terminal block 180 are used to connect the electrical wiring. The solenoid valve 370 is also connected to the manual water shut off 372 on the city water in pipe 8 and a backflow preventer 376. The size and length of the bracket 210 are selected so as to enable the system and device of the present invention 5 to be positioned substantially under the water runoff from the pressure relief valve 7. In operation, the funnel 200 collects the condensed water from the steam exiting the pressure relief valve 7 on a steam boiler 25 and directs it into the hollow pipe 120, where the water activates a float switch or switches, shutting off the solenoid valve 370.

Figure 20:
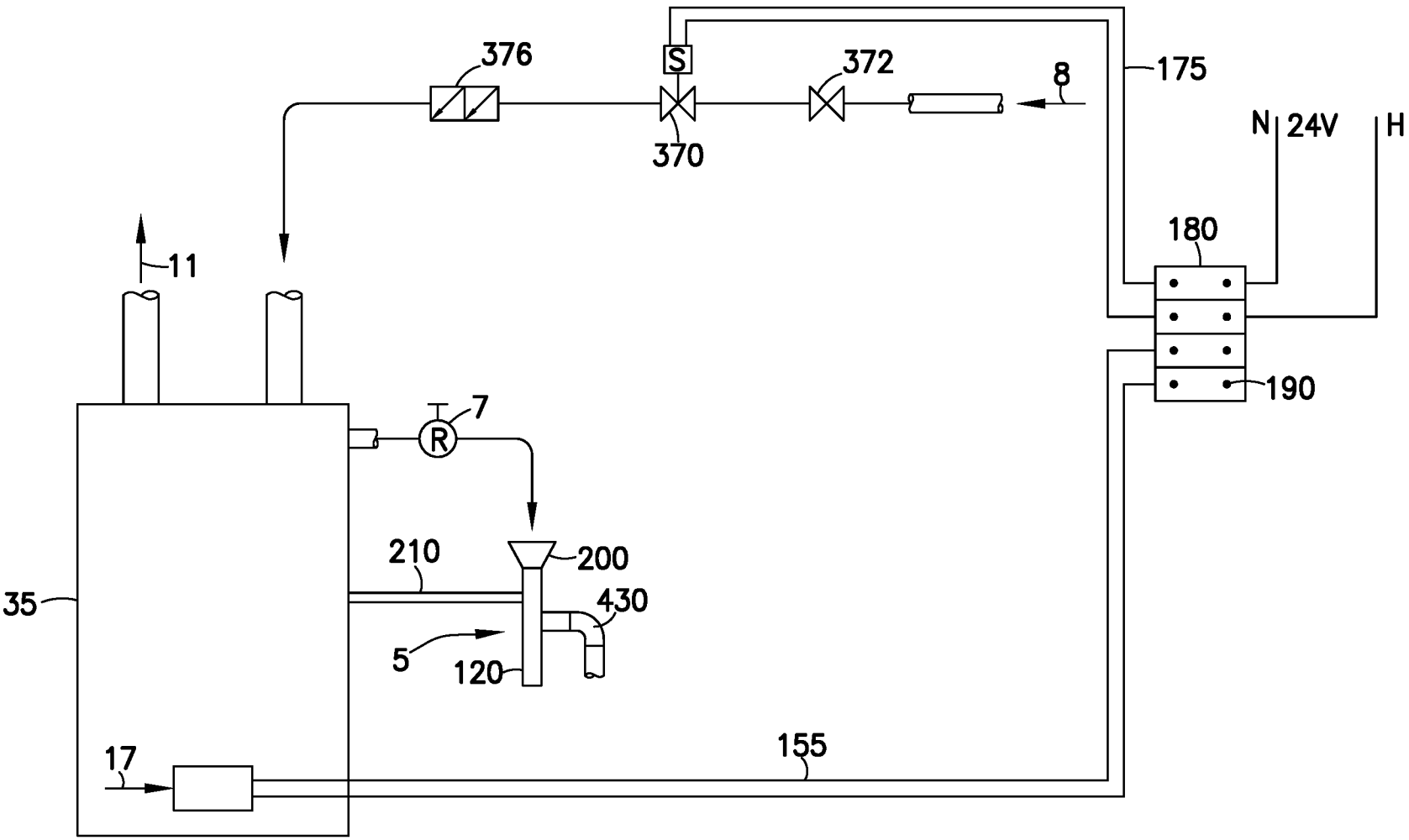
FIG. 20 is a diagram of the system and device of the present invention being used with a hot water tank.

FIG. 20 illustrates the operation of the system and device 5 of the present invention with a hot water tank. With reference to FIG. 20, the hot water tank 35 has a city water in pipe 8, a hot water supply pipe 11, a burner assembly 17, a pressure relief valve 7, and electrical wiring 155 (the limits connection) connected to the hot water tank 35. The system and device of the present invention 5 (Overflow Preventer) is connected to the hot water tank 35 by a bracket 210. The system and device of the present invention 5 include a hollow pipe 120 (housing) with a connected funnel 200 as described in this specification and a downward-pointed pipe 430 connected to the hollow pipe 120. The downward-pointed pipe 430 releases excess water from the hollow pipe 120 to ensure pressure does not build up inside.

The terminal block 180 in the Over flow Preventer is wired to the hot water tank 35 limits through the electrical wiring 155, is wired to the hot and neutral 24 V power, and is wired to the solenoid valve 370 by the electric wiring 175. The terminal screws 190 on the terminal block 180 are used to connect the electrical wiring. The solenoid valve 370 is also connected to the manual water shut off 372 on the city water in pipe 8. The size and length of the bracket 210 are selected so as to enable the system and device of the present invention 5 to be positioned substantially under the water runoff from the pressure relief valve 7. In operation, the funnel 200 collects the water runoff and directs it into the hollow pipe 120, where the water activates a float switch or switches, shutting off the solenoid valve 370 and/or the burner assembly 17.

Figure 21:
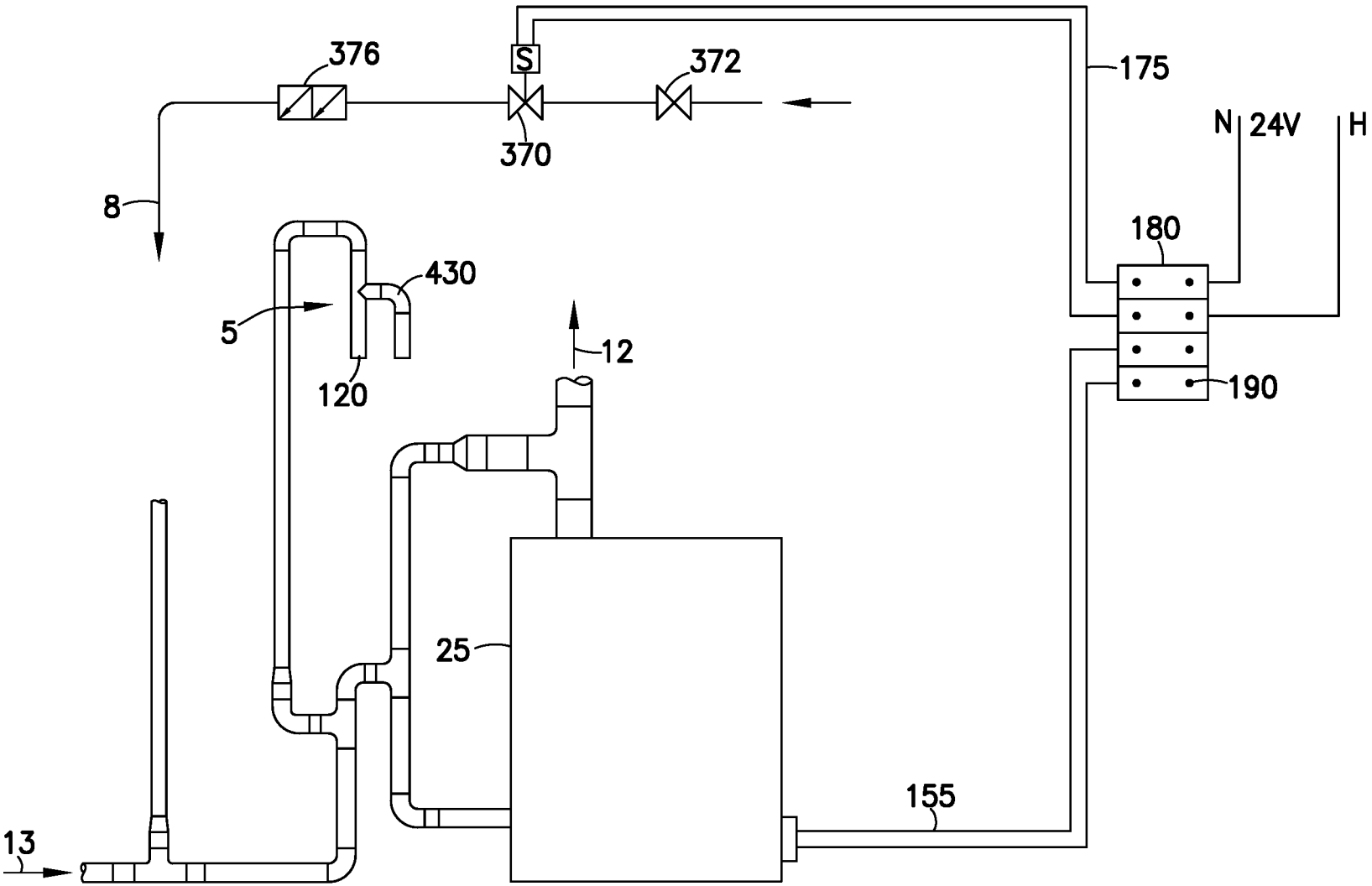
FIG. 21 is a diagram of the system and device of the present invention being used on a steam boiler return.

A secondary or standalone Overflow Preventer may be configured on a steam boiler return. With reference to FIG. 21, the steam boiler 25 has a city water in pipe 8, a steam supply pipe 12, a condensate return pipe 13, and electrical wiring 155 (the limits connection) connected to the steam boiler 25. The system and device of the present invention 5 (Overflow Preventer) is connected to the condensate return pipe 13 of the steam boiler 25 as shown and as described in this specification. The system and device of the present invention 5 include a hollow pipe 120 (housing), which is directly connected to the condensate return pipe 13, and a downward-pointed pipe 430 connected to the hollow pipe 120. The downward-pointed pipe 430 releases excess condensed water from the hollow pipe 120 to ensure pressure does not build up inside.

The terminal block 180 in the Over flow Preventer is wired to the steam boiler 25 limits through the electrical wiring 155, is wired to the hot and neutral 24 V power, and is wired to the solenoid valve 370 by the electric wiring 175. The terminal screws 190 on the terminal block 180 are used to connect the electrical wiring. The solenoid valve 370 is also connected to the manual water shut off 372 and a backflow preventer 376. In operation, the hollow pipe 120 collects the condensed water from the steam exiting condensate return pipe 13 on the steam boiler 25, where (in the hollow pipe 120) the water activates a float switch or switches, shutting off the solenoid valve 370.

Figure 22:
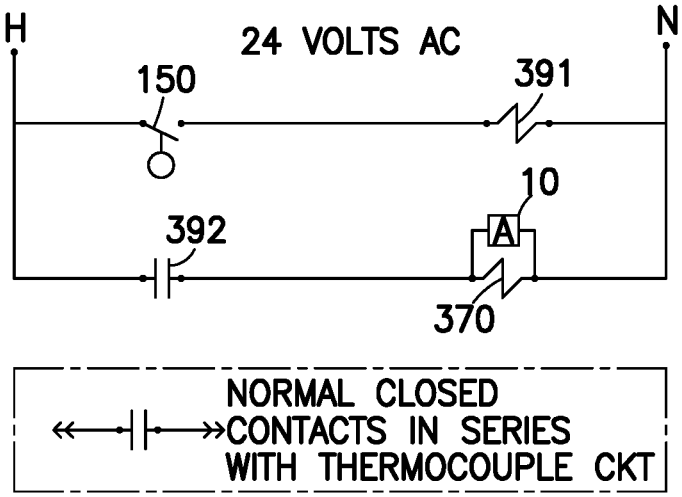
FIG. 22 is an electrical schematic of the system and device of the present invention being used with a hot water tank.

With reference to FIGS. 22 and 24, an electrical schematic of the system and device of the present invention being used with a hot water tank as shown in FIG. 20 and the relay printed circuit board (PCB) is shown as follows: a float switch 150 is electrically connected with a relay solenoid 391 in series, and they are connected in parallel to the hot and neutral 24 V power supply from a transformer and a combination of relay contacts 392 electrically connected with a solenoid valve 370 in series. An alarm module 10 is preferably also connected in parallel with the solenoid valve 370. The relay contacts 392 are normally closed contacts, electrically connected in series with a thermocouple (temperature sensing) circuit. The normally closed relay contacts 392 allow the system to operate normally. If any system over pressurizes, the system and device of the present invention 5 (Overflow Preventer) accumulates water until the float switch 150 closes and energizes the relay coil. When the relay coil is energized, it opens normally closed contacts and closes the normally open contacts. Opening the normally closed relay contacts 392 shuts down the unit (boiler, water tank, etc.), usually by opening the contacts on limit switches and shutting off the burners of the unit, and closing the normally open contacts activates the solenoid valve 370 to shut off the water supply and/or alarm module 10 (audible alarm, lights, and/or wireless communication to the owner/operator of the unit).

Specifically with reference to FIG. 24, the contacts of the PCB are 1-2 (normally closed contacts to limits in series with the limits), 3-4 (normally open contacts in series with the solenoid valve 370 and/or alarm module 10, 5-6 (the relay coil terminals), 7-8 (the limits), 9-10 (the float switch 150), 11 (24 V hot electric power), 12-13 (solenoid valve 370 and/or alarm module 10), and 14 (24 V neutral).

Figure 23:
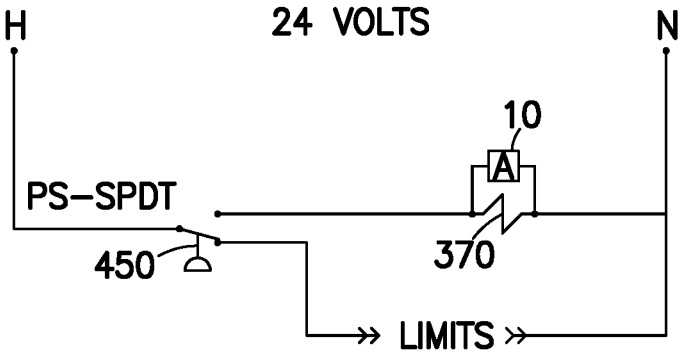
FIG. 23 is an electrical schematic of the system and device of the present invention being used with a hot water boiler.

Although the preferred and alternative embodiments previously described use float switches to illustrate the operation of the system and device of the present invention, all of the embodiments may be assembled and used with an air pressure switch instead of a float switch. For example, with reference to FIG. 23, which is an electrical schematic of the system and device of the present invention being used with a hot water boiler, a pressure switch 450 (single pole double throw) is electrically connected in series with the limits of the boiler unit and connected to the hot and neutral 24 V power. When the pressure switch 450 is activated, it opens the limits connection, which in turn deactivates the burner unit of the boiler, effectively shutting it down, and closes the circuit with the solenoid valve 370 (in series), which forces the solenoid valve to shut off the water supply to the unit. Again, an alarm module 10 may be connected in parallel with the solenoid valve 370 to provide audio, visual, and wireless notification to the owner/operator of the unit.

Although not necessary to the operation of the system and device of the present invention, to improve the safety of heating systems, boilers and steam boilers burning natural gas, and sewer systems, the system and device may include electrical and/or electronic control and/or monitoring circuits and mechanisms, monitoring the water flow through the pipe, using various optical, electrical, mechanical, and other sensors positions in or about the system and device.

Two other alternative embodiments of the present invention are illustrated in FIGS. 25-30. With just a few modifications of the overflow preventer suitable for boilers and hot water heaters, the device and system of the present invention may be used for a sewerage or water drainage system. This device and system can detect the sewer backing up before the damage is done, shut off the water to immediately stop the backup, and notify the owner of the problem, avoiding a very messy, unsanitary, and hazardous issue.

Figure 25:
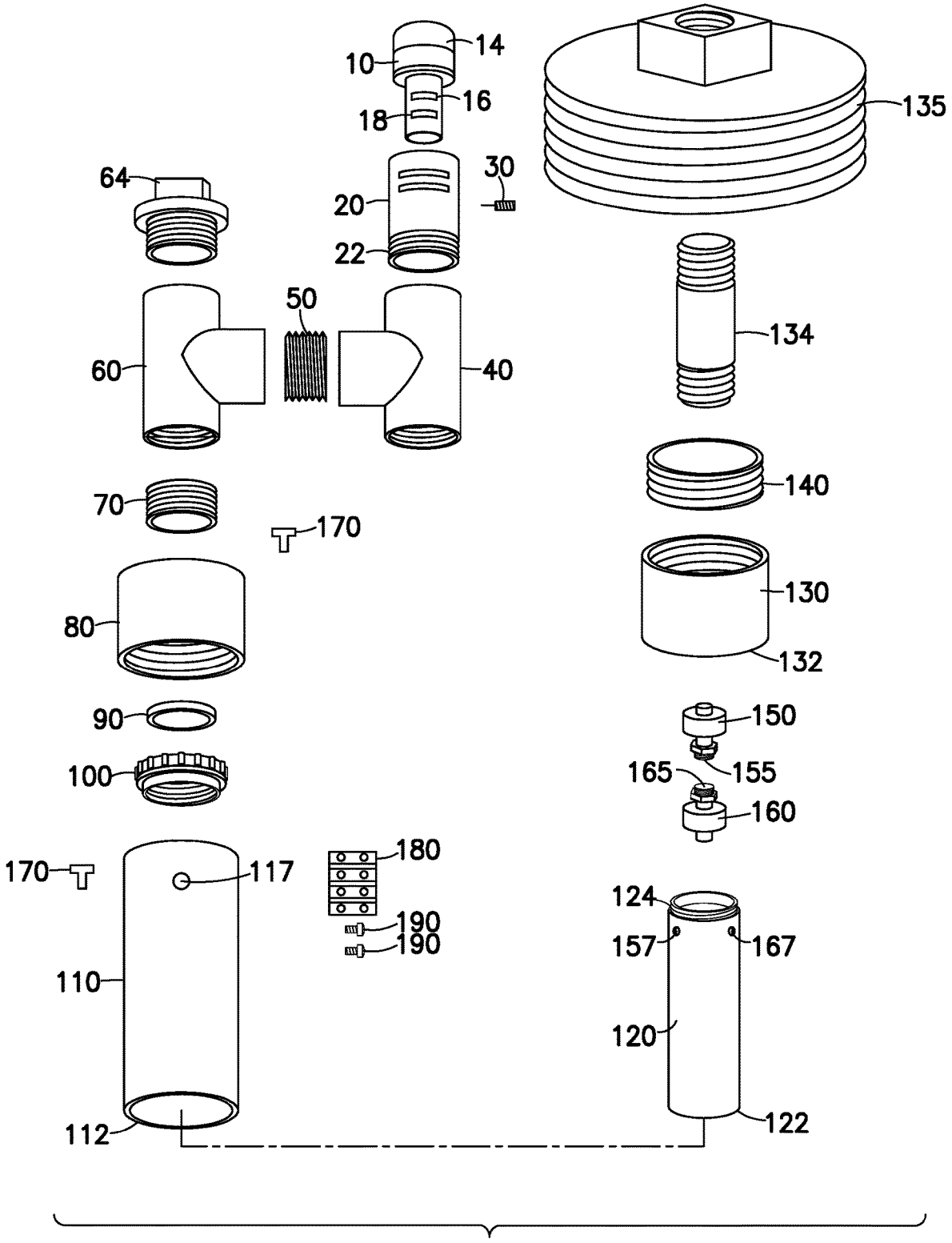
FIG. 25 is a perspective exploded view of yet another alternative embodiment of the system of the present invention for sewerage and water drainage systems application, including a hollow pipe in a housing with a partially-open bottom end for the accumulation of water from the sewerage or water drainage system through the cleanout plug and nipple and the activation of float switches positioned in the hollow pipe, and an alarm module held in the alarm module housing connected by tees and other parts to complete the system.
Figure 26:
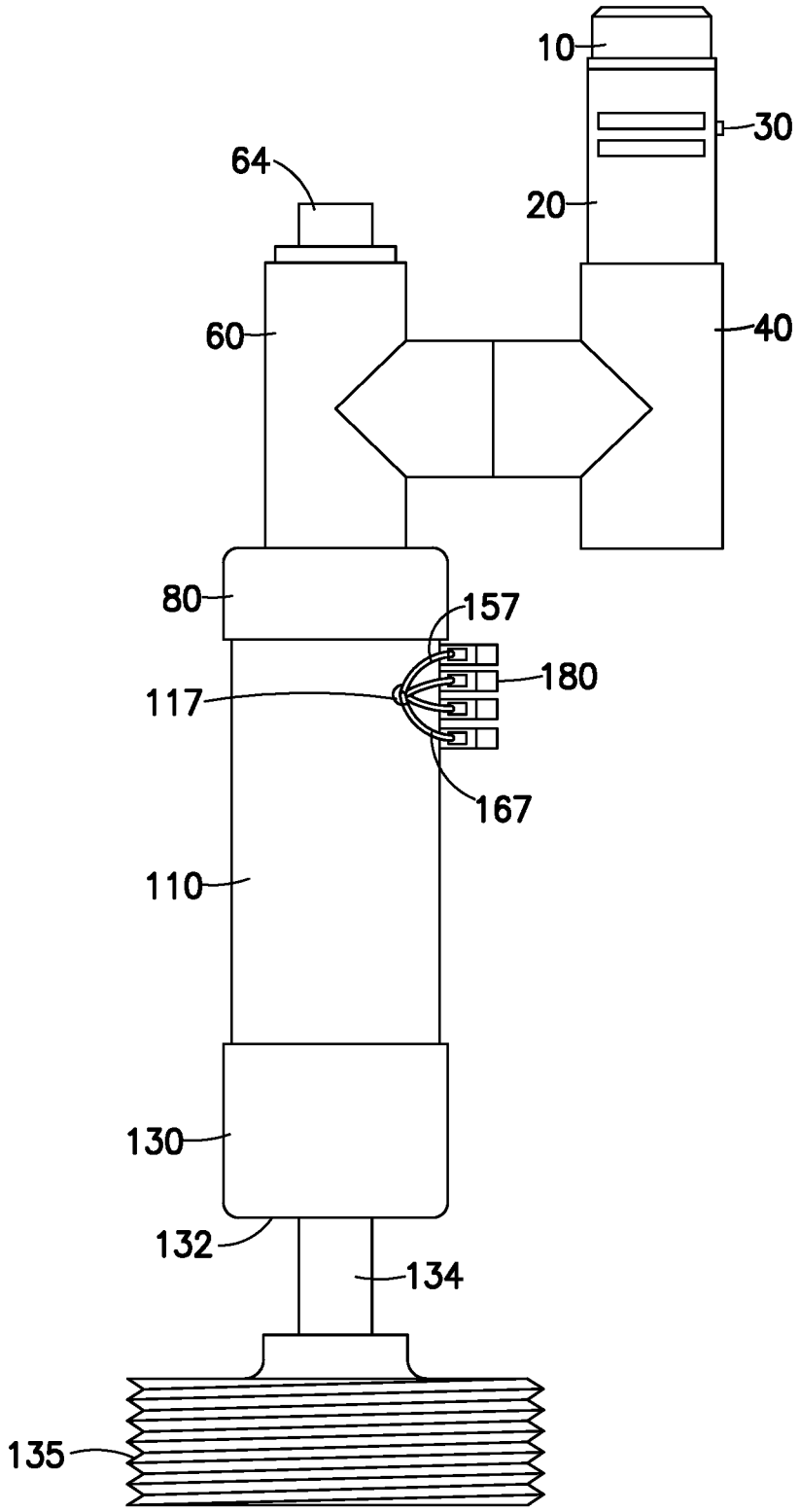
FIG. 26 is a side view of the fully assembled alternative embodiment illustrated in FIG. 25, illustrating a cap with a nipple capable of mating with a cooperating sewerage or water drainage system plug (the cleanout plug), typically installed in the cleanout aperture of the main sewer trap.

With reference to FIGS. 25-26, the particular embodiment illustrated in FIGS. 3-4 may be modified to include a nipple in the cap closing the bottom end of the overflow preventer. Specifically, and with reference to FIG. 25, the system and device of the present invention for sewerage and water drainage systems are made from a hollow pipe 120 (serving as the core), which is designed for substantially vertical mounting and has a bottom end 122, and an open top end 124. The hollow pipe 120 is preferably made of copper or other suitable, corrosion-resistant material such as those disclosed herein, and the preferred diameter hollow pipe 120 is one inch (1") or 1½". The bottom end 122 does not need to be capped or plugged in this embodiment because the hollow pipe 120 is housed inside a housing 110, which may be made from Chlorinated Polyvinyl Chloride (CPVC), stainless steel, cast iron, copper, brass or any other suitable material as disclosed herein. The diameter of the housing 110 is preferably 1½", but at least sufficient to accommodate the diameter and length of the hollow pipe 120 and the easy insertion and removal of the hollow pipe 120 into the housing 110. The housing 110 has the bottom end 112, which is capped with a female adapter 130 (a cap), having a closed or plugged bottom end 132 with a hollow nipple 134 in fluid communication with the housing 110. The nipple 134 is preferably directly connected to, and is in fluid communication with, the cleanout plug 135. The cleanout plug 135 has a longitudinal bore into which the nipple 134 is connected, preferably by reciprocating threading. Since no devices such as described herein were available, the Applicant drilled and tapped the longitudinal bore in a conventional (solid) cleanout plug to create the cleanout plug 135, imparting a female thread to the longitudinal bore, cooperating with the male thread of the nipple 134.

Figure 28:
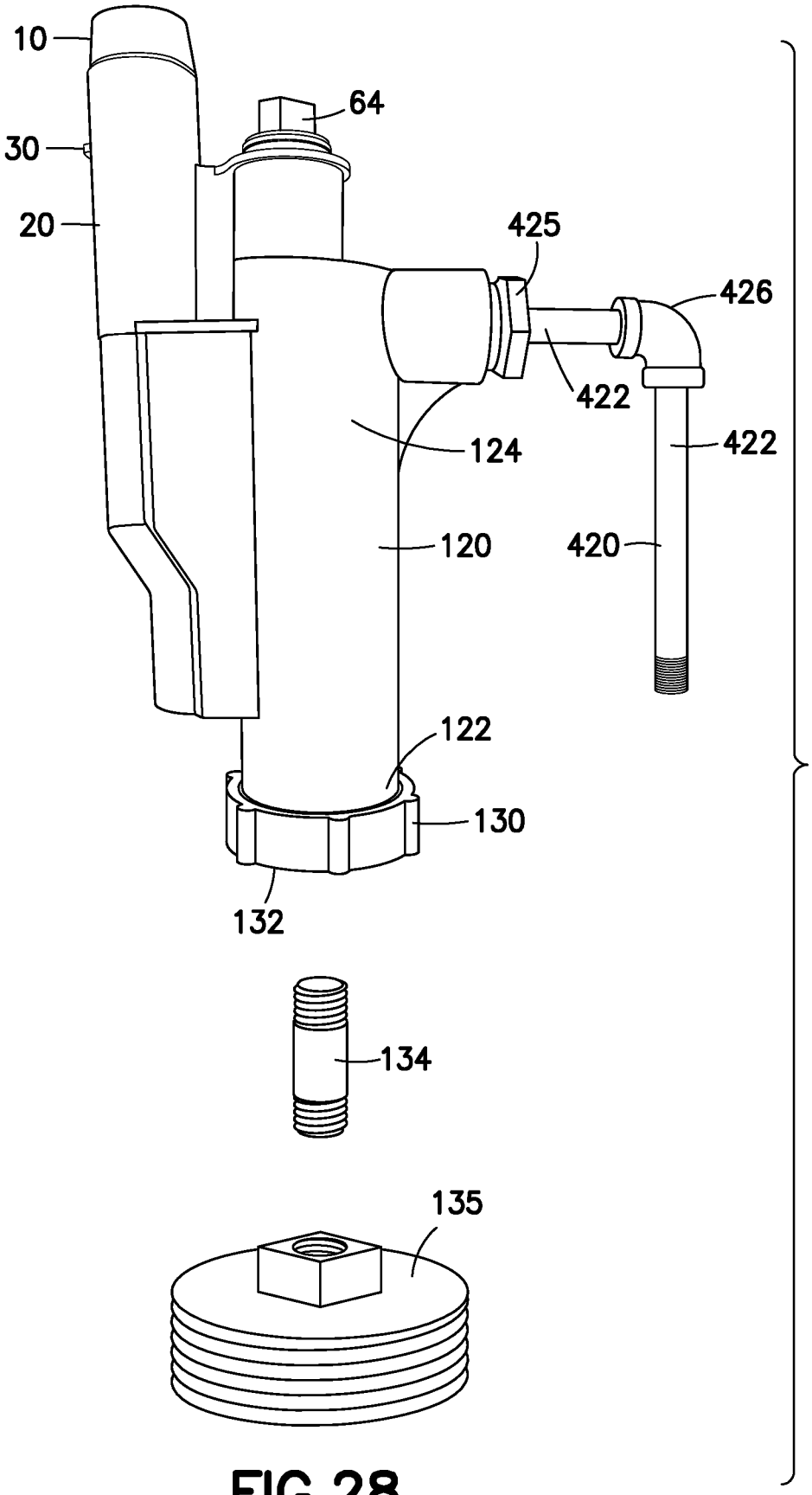
FIG. 28 is a partially-exploded perspective view of the embodiment of FIG. 27, illustrating the nipple used to connect the cap to the cleanout plug, with a variation where the downward-pointing drain pipe is assembled from two straight pipes and an elbow connector.

For example, the nipple 134 may have male thread on both ends and the cleanout plug 135 and the cap 130 reciprocal female threads to enable a secure connection as illustrated in FIG. 28. Alternatively, the nipple 134 may have a male thread to connect to the cap 130 and a female thread on the opposite end, which would be connected to the cleanout plug 135 (with a female thread) by an optional plumbing pipe that has cooperating male thread on both ends. The plumbing pipe is preferably of a short length to enable the mounting of overflow prevented in the cleanout area below the floor level, and any copper, brass, steel, PVC or other plumbing pipe may be used.

The cleanout plug 135 is cooperatively sized to fit into a cleanout aperture that is otherwise plugged by a common cleanout plug, also called a sewer cleanout cap. Such plugs or caps are typically installed in the street-side and house-side cleanout apertures of the main sewer trap. The size of such plugs or caps is typically 4 inches in diameter, but they can also be 3 inches or 6 inches, so cleanout plugs 135 may be sized appropriately and threaded as needed to be mounted into the cleanout aperture. The envisioned method of installation of this embodiment of the device and system of the present invention is into the house-side cleanout aperture, but the device and system of the present invention may also be installed on the street side.

Threading is the preferred installation method, by the cleanout plugs 135 may also be installed using snaps, latches, rails, friction installations, Luer Lock connection or another connection method known in the art. The nipple 134 is connected to the female adapter 130 at its bottom end 132 by reciprocal threading or other methods known in the art (i.e., the nipple 134 may be a common NPT nipple with male threading on both ends: one end is connected into the bottom end 132 of the cap 130 and the other end into the cleanout plug 135. Alternatively, the female adapter 130 may be integrally formed with the nipple 134 as a one-piece part using suitable materials such as PVC, copper, brass, steel, or other suitable materials, with the PVC being the preferred material due to the ease with which such a female adapter 130 may be formed from PVC versus various metals.

Figure 27:
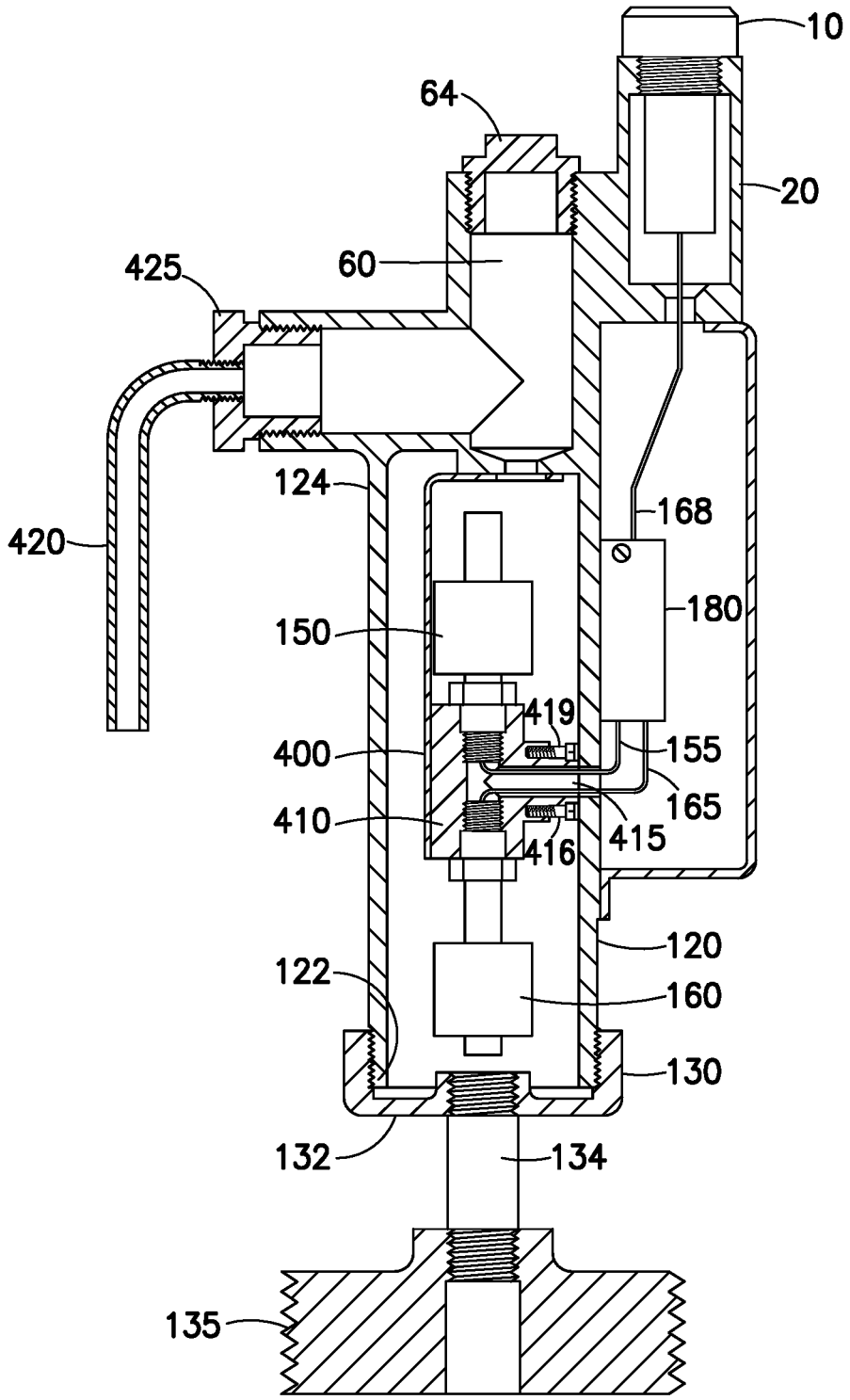
FIG. 27 is a side cross-sectional view of another one of the preferred embodiments of the system and device of the present invention for sewerage and water drainage systems, with a one-piece curved downward drain pipe.

The female adapter 130 is preferably connected to the bottom end 112 of the housing 110 by the close nipple 140, but it may be connected to the bottom end 112 via reciprocal threading as illustrated in FIG. 27. The capped female adapter 130 ensures that the water or sewage backup up from the sewerage or water drainage system accumulates inside the housing 110 through the nipple 134, filling the hollow pipe 120 and triggering the float switches 150 and 160. The female adapter 130 and the close nipple 140 are preferably CPVC, and both are preferably of 1½" in diameter.

The float switches 150 and 160 are connected to the water valve and/or the optional alarm module 10 by electrical wiring 155 and 165 respectively, which passes through apertures 157 and 167 in the hollow pipe 120 respectively and come out of the aperture 117 in the housing 110. The wiring 155 and 165 is connected to the terminal block 180, which uses terminal block screws 190 to secure, connect and disconnect the wiring. The electrical connections to and from the terminal block 180 are illustrated in FIG. 7, where a water valve shutoff solenoid 370 is connected in series with the float switch 150 and connected in parallel with the alarm module 10. The wiring 165 (closed circuit) illustrates that the float switch 160 was activated, but the open circuit of the wiring 155 illustrates that the float switch 150 has not yet been activated, and the electric wiring 175 sends the close the valve command by opening or closing the electrical circuit of the solenoid 370 or switches from the terminal block 180 by electrical wiring 175. Alternatively, the valve may be a motorized or electrically-actuated ball valve, but in any case the closing of the valve is performed after the float switch 160 is activated, regardless of whether the closing signal travels to a solenoid, electric motor, or another type of electrical actuator.

The entire electrical circuit, including float switch, alarm, and water valve shut off is illustrated in FIG. 8, same as for a gas shutoff valve of a boiler as described in this disclosure but without the limit switch because in this embodiment the signal to close the water valve travels via the electrical wiring directly to the solenoid 370 that closes the valve, or to the electric motor or other electrical actuator of the valve. There may be another float switch 160 connected in parallel with the alarm module 10 and a shut off another valve solenoid 380 (for example, the two levels of shut-off may be local and main water lines, each closed by its own solenoid, electric motor or another actuator).

The housing 110 is connected to a cap 80, which may be made from the same or a different material than the housing 110 a locknut 100, having a washer 90 between the locknut 100 and the cap 80. The locknut 100 is preferably a ¾" diameter brass, and the washer 90 is preferably rubber, but other suitable materials may be used. the cap is preferably the same diameter and the housing 110 (i.e., 1½"), The cap 80 is connected to the downward in-line arm of the threaded Tee 60 by the means of a threaded close nipple 70, which is preferably ¾" diameter brass. The threaded Tee 60 is preferably a ¾" diameter CPVC, and the transverse arm of the treaded Tee 60 it is connected to the transverse arm of another threaded Tee 40 by a threaded close nipple 50, which is also preferably ¾" diameter brass. The threaded Tee 40 is also preferably a ¾" diameter CPVC. There is an alarm module housing 20 connected to the threaded Tee 40 by the threaded bottom end 22 of the alarm module housing 20. The alarm module 10 is held in place in the alarm module housing 20 by the set screw 30. The alarm module 10 is electrically connected to one or more of the float switches 150 and 160, and the alarm module contains a light source, such as a lamp, LED, or strobe light 14, and/or a sound transducer 16 such as a speaker, piezo buzzer, or another type of audible alarm. The alarm module may also contain electrical, electronic, and/or communications circuitry 18 to communicate with the owner of the operator of the boiler that the water is leaking from the pressure relief valve when one or more of the float switches 150 and 160 are activated. The communications may be by connecting into the home network or Wi-Fi wireless signal, or by initiating a landline or cellular telephone call, email or text message.

Figure 30:
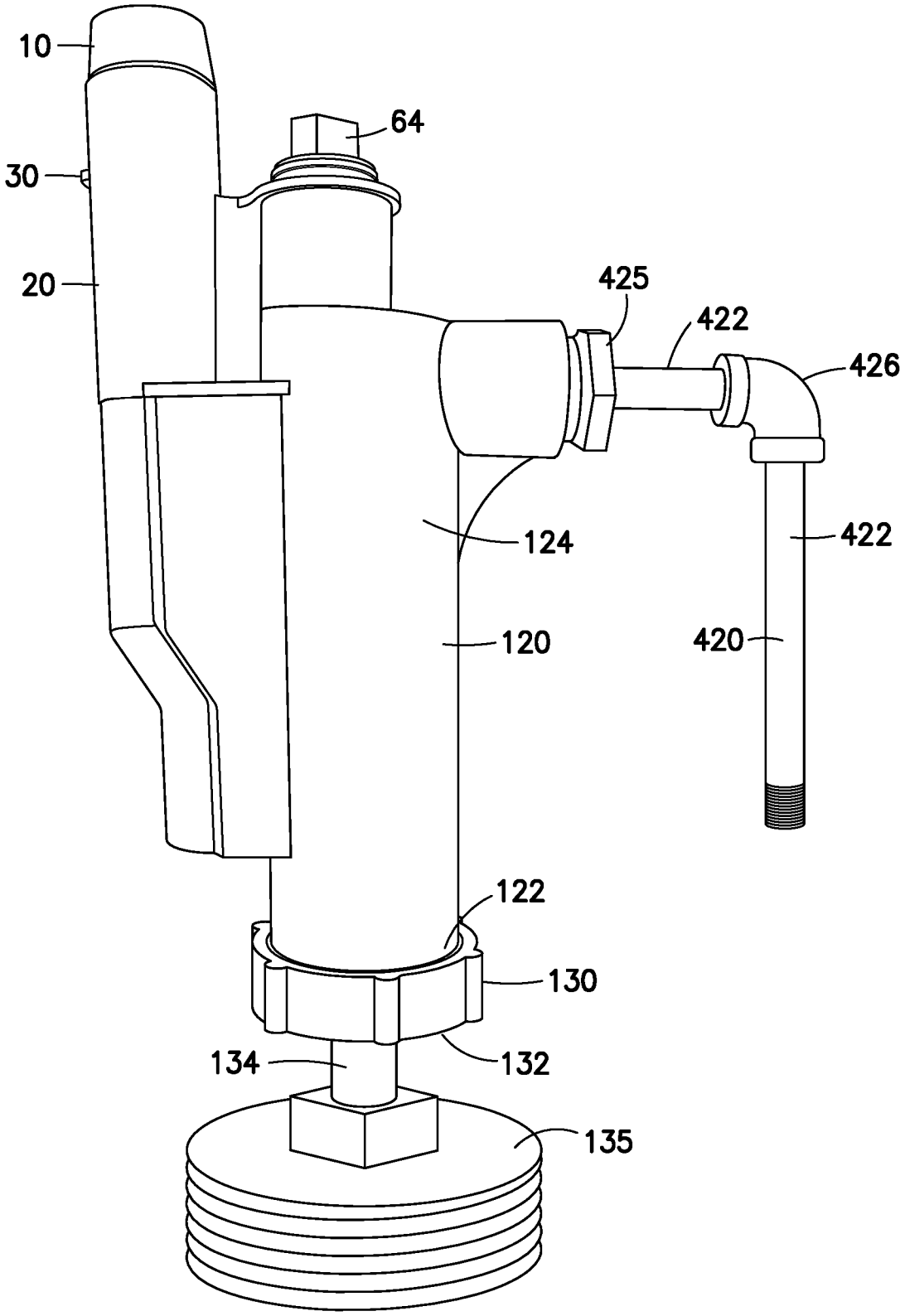
FIG. 30 is a perspective view illustrating a fully-assembled embodiment illustrated in FIG. 28.

The terminal block 180 is preferably attached to the housing 110 as illustrated in FIG. 26, which shows the fully-assembled embodiment of FIG. 25. As shown in FIGS. 26 and 30, the system and device of the present invention connect to the cleanout aperture of a sewerage or drainage system by the threaded cleanout plug 135. The downward in-line arm of the threaded Tee 60 is connected to the housing 110 as described above, and the opposite in-line arm of the threaded Tee 60 (the upward arm) is plugged by a plug 64, preferably using cooperating threading or other connection means. This upward in-line arm of the threaded Tee 60 would otherwise be connected to the pressure relief valve of a boiler in the embodiment serving boilers and hot water heaters, but it is not in use in this embodiment.

The transverse arms of the threaded Tee 40 and the threaded Tee 60 are connected, preferably via a threaded close nipple 50. The upward in-line arm of the threaded Tee 40 supports the alarm module housing 20 and the alarm module 10, held by the set screw 30, on a separate "branch" of the system and device, so they are not affected by the water or sewage flooding the housing 110 upwards from the sewerage or water drainage system, where the fluid accumulates because the female adapter 130 caps the housing 110. The water fills the housing 110 and the hollow pipe 120 through the plug 135 and the nipple 134, and triggers the float switches 150 and 160 illustrated in FIG. 25. The downward in-line arm of the threaded Tee 40 is used for the runoff of excess sewage, water and/or air when the housing 110 of the device fills up.

The wiring 157 and 167, passing through the aperture 117 in the housing 110 enables the float switches 150 and 160 to open or close the electrical circuits of the water valve (or two water valves for local and main lines) or perform other functions, such as activating a visual or sound alarm, or by initiating a landline or cellular telephone call, email or text message to the owner, possibly over the Wi-Fi home network.

The alarm housing 20 and the alarm module 10 are on a separate branch, parallel to the main device, so they do not take up any vertical space, which is useful when installing the overflow preventer in a pit below floor level with limited vertical clearance. In this configuration, the housing 110 with the hollow pipe 120 and the float switches 150 and 160 would rise above the line, mounted over the cleanout plug.

Figure 29:
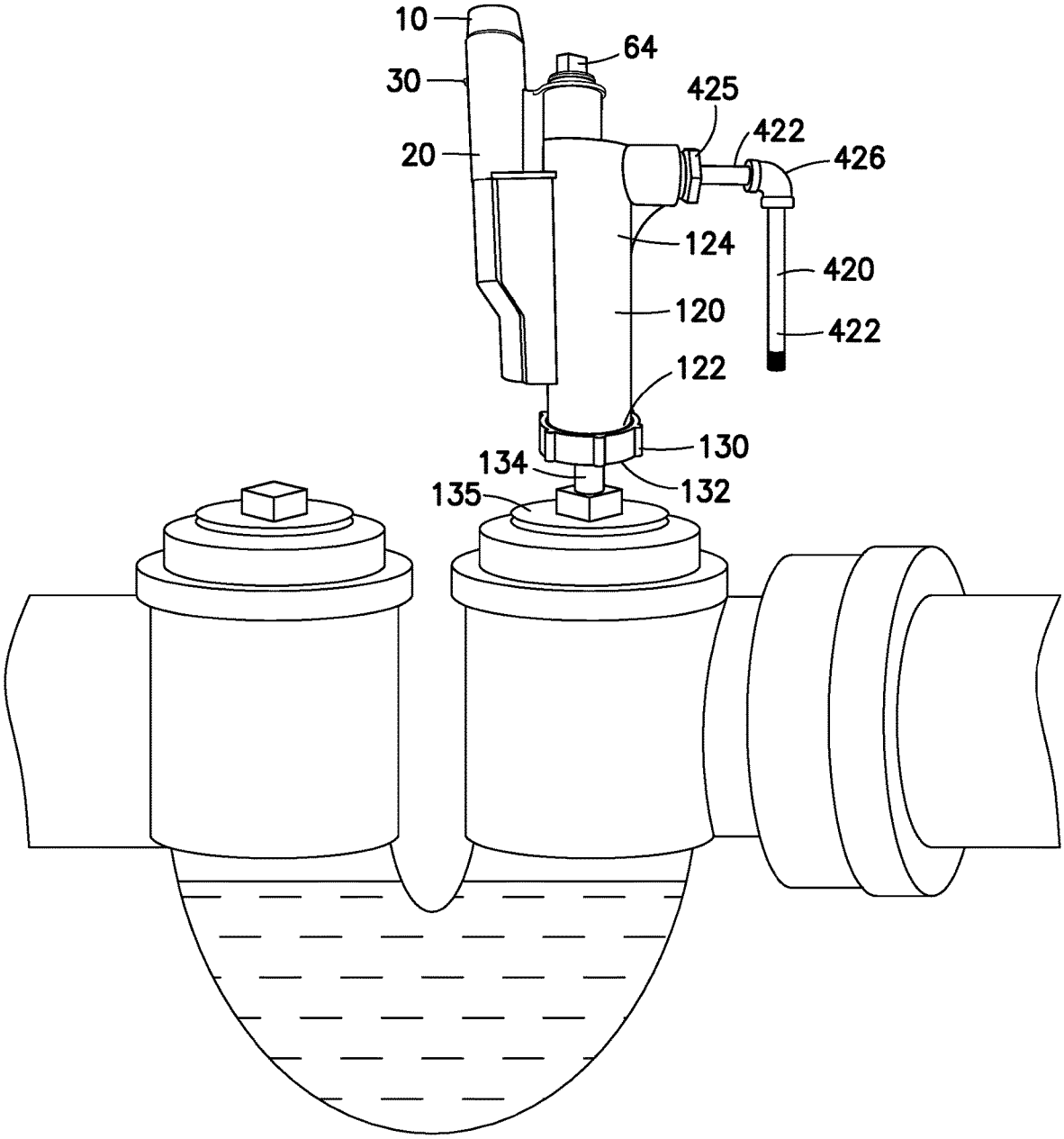
FIG. 29 is a perspective view illustrating a typical installation of the embodiments illustrated in FIGS. 27 and 28 in the cleanout plug of a sewerage system.

The overflow preventer for sewerage and water drainage systems typically connects to the sewer trap plug or cleanout plug as illustrated in FIG. 29, where the device is preferably installed in the house-side cleanout aperture. Therefore, the device and system of the present invention will not interfere with the normal flow of water or sewage. If the homeowner does not have a cleanout, it makes good practical sense installing one so that an overflow preventer of the present invention may be installed.

Yes another alternative embodiment of the Overflow Preventer for sewerage and drainage systems is illustrated in FIG. 27, which is a modification of the embodiment illustrated in FIG. 14. The Overflow Preventer has a housing in the form of a hollow pipe 120, which is designed for substantially vertical mounting and has a bottom end 122, which is substantially closed (i.e., to allow some fluid through) but permits the accumulation of water in the hollow pipe 120, and an open or substantially open top end 124. In this embodiment, the open top end 124 is plugged by a plug 64, preferably using cooperating threading or other connection means to the open end 124. The open end 124 was originally designed for attaching the housing to the pressure relief valve of a boiler, but it is not used in this embodiment. In fact, the open end 124 may be permanently sealed or closed when the device is manufactured specifically for the sewerage and drainage systems application, making it a closed end rather than the open end 124, which would obviate the necessity of using a separate plug 64. The hollow pipe 120 is preferably made of copper or other suitable, corrosion-resistant material such as those disclosed herein, and the preferred diameter hollow pipe 120 is one inch (1"), but it could be ¾" to match the standard diameter of the pressure relief valves. Alternatively, the hollow pipe 120 may be 1" but use a ¾" adaptor to connect to the pressure relief valve. It should be noted that although a hollow pipe 120 is the preferred shape of the housing, the housing may be of any other shape or size with an internal cavity.

The bottom end 122 of the hollow pipe 120 is capped with a cap 130 to allow the accumulation of water inside the hollow pipe 120. The cap 130 has a bottom end 132 with a hollow nipple 134 in fluid communication with the housing 110. The nipple 134 is preferably directly connected to, and is in fluid communication with, the cleanout plug 135. The cleanout plug 135 has a longitudinal bore into which the nipple 134 is connected, preferably by reciprocating threading.

As described, the nipple 134 may have male thread on both ends and the cleanout plug 135 and the cap 130 reciprocal female threads to enable a secure connection as illustrated in FIG. 28. Alternatively, the nipple 134 may have a male thread to connect to the cap 130 and a female thread on the opposite end, which would be connected to the cleanout plug 135 (with a female thread) by an optional plumbing pipe that has cooperating male thread on both ends. The plumbing pipe is preferably of a short length to enable the mounting of overflow prevented in the cleanout area below the floor level, and any copper, brass, steel, PVC or other plumbing pipe may be used.

The cleanout plug 135 is cooperatively sized to fit into a cleanout aperture that is otherwise plugged by a common cleanout plug, also called a sewer cleanout cap. The size of such plugs or caps is typically 4 inches in diameter, but they can also be 3 inches or 6 inches, so cleanout plugs 135 may be sized appropriately. The nipple 134 is connected to the cap 130 at its bottom end 132 by reciprocal threading or other methods known in the art (i.e., the nipple 134 may be a common NPT nipple with male threading on both ends: one end is connected into the bottom end 132 and the other end into the cleanout plug 135. Alternatively, the cap 130 may be integrally formed with the nipple 134 as a one-piece part using suitable materials such as PVC, copper, brass, steel, or other suitable materials, with the PVC being the preferred material due to the ease with which such a cap 130 may be formed from PVC versus various metals.

There may also be a downward-pointed pipe 420 attached to the hollow pipe 120 above the top end 124 to channel excess fluid and/or air away from the device after it accumulates in the housing (hollow pipe) 120. The pipe 420 may be attached directly to the device or it may be attached by a diameter adapter 425 as illustrated in FIG. 27, preferably using reciprocating threading. Thus, the downward-pointed pipe 420 essentially serves as a fluid and/or air vent, which can be automatic. Using the pipe 420 ensures that no excess pressure builds inside the hollow pipe 120, but still enables sufficient fluid amounts to be collected for the proper operation of the device. Although the downward-pointed pipe 420 may be manufactured as one-piece bent pipe as illustrated in FIG. 27, it may also be easily assembled from common plumbing elements as illustrated in FIGS. 28 and 30: two pieces of straight pipe 422 and a pipe elbow (or knee) fitting 426.

There is at least one float switch 150 disposed, positioned or mounted inside the hollow pipe 120. The height of the mounting of the float switch 150 inside the hollow pipe 120 determines how early the switch is activated. Although the float switch 150 may be permanently or semi-permanently mounted, it is preferably mounted in a semi-permanent (detachable) way, preferably to the connector block 410, so that the float switch 150 may be easily replaced. The connector block 410 has one or more apertures 412 cooperating in size and positioning with the respective one or more apertures 416 in the hollow pipe 120. For removable mounting, the apertures 412 and 416 are aligned, and the connector block 410 holding the float switch 150 is secured to the hollow pipe 120 by screws 419 of appropriate size. The connector block 410 also preferably has an aperture 415 aligned with the aperture in the hollow pipe 417, through which apertures wiring from the float switch 150 is connected to the terminal block 180. Additionally, the position of the float switch 150 inside the hollow pipe 120 may be adjustable, so that the user or the installer may vary how soon the switch is activated by selectively installing the float switch 150 higher or lower inside the hollow pipe 120.

The float switch 150 is electrically connected to one or more valves of the sewerage or drainage system, such as by water-resistant or waterproof electrical wiring 155 that passes through apertures 415 in the connector block 410 and 417 in the hollow pipe 120 to connect to the terminal block 180 and from that to reach the valves. It should be noted that the end of the runoff pipe 420 should be positioned above the float switch 150 to ensure that the water does not leak out or drip before reaching the bottom end 132 of the cap 130, as illustrated in FIG. 27 to enable the mounting of the device into a cleanout aperture. Unlike in the embodiment of the present invention for boilers and water heaters, the float switch 150 does not need to be covered by a protective plate 400 to ensure that the float switch 150 is not tripped before sufficient water accumulates in the hollow pipe 120 because the water is not coming from above—it is coming from below, through the cleanout plug 135 and nipple 134.

As illustrated in FIG. 27, there may be two float switches 150 and 160 disposed inside the hollow pipe 120, both connected to the connector block 410. The float switches 150 and 160 are electrically connected to one or more valves of the system, as illustrated in FIG. 27, such as by water-resistant or waterproof electrical wiring 155 and 165 passing through apertures 415 in the connector block 410 and 417 in the hollow pipe 120 to connect to the terminal block 180. In operation, the bottom float switch 160 may give an early visual and/or audible warning to the operator or owner of the boiler by being electrically connected to the optional alarm module 10 through electrical wiring through the terminal block 180 as illustrated in FIG. 27. In this and all of the described embodiments, a single float switch 150 with a relay 390 as illustrated in FIGS. 16-17 can perform the same functions as two float switches illustrated in FIG. 27.

In operation of the sewerage and drainage overflow preventer, an alarm via the alarm module 10 is activated once the water reaches an unsafe level, causing the hollow pipe 120 of the device to fill with fluid (i.e., water or sewage) from the cleanout aperture and through the cleanout plug 135 and nipple 134. If the lever rises, the device send a message to shut off the main water supply so that the backup is not made worse by use of the showers, toilets, sinks, washing machines, or dishwashers. It should be noted that the order of these functions is interchangeable as desired (i.e., the alarm may be activated first and the water shut off second as the fluid level rises, or the water may be shut off first and the alarm activated second as the fluid level rises.

In an alternative embodiment, the system and device may include a controller or a programmable controller to further improve the efficiency of the system and device of the present invention. Such a controller may include a number of programs and/or settings that take into consideration the communications and warnings/alarms to the operator or owner via the alarm module or other communication means such as telephone or Wi-Fi. The controller may be an independent computer, a chip-based controller, or a different controller known in the art.

These configurations will enable the system and device disclosed in the specification of the present invention to improve the safety of the heating systems and boilers in any gas-burning system or device, as well as the safety of the sewerage and drainage systems.

Anyone can use the system and device of the present invention to improve the safety of boilers and steam boilers, as well as sewerage and drainage systems, providing additional safety, cost savings, and other benefits of safer, more efficient operation. The dimensioning and sizing of the system and device of the present invention to improve the safety of boilers and steam boilers burning natural gas (i.e., the sizing and shapes of the pipes, fittings, threading, and housings), as well as sewerage and drainage systems, may be easily determined by those skilled in the art, but the applicant envisions that the system and device may be made with varying sizes, height/length, width/diameter, and other parameters.

While the system and device to improve the safety of boilers and steam boilers burning natural gas, as well as sewerage and drainage systems, of the present invention have been shown and described in accordance with the preferred and practical embodiments thereof, it is recognized that departures from the instant disclosure are contemplated within the spirit and scope of the present invention. Therefore, the true scope of the invention should not be limited by the abovementioned description of the preferred embodiments since other modifications may become apparent to those skilled in the art upon a study of the drawings, description, explanations, and specifications herein. Various modifications to these embodiments will be readily apparent to those skilled in the art, and the principles described herein can be applied to other embodiments without departing from the spirit or scope of the invention and the subject matter of the present invention.

What is claimed is:

1. A sewerage and drainage system overflow preventer device, comprising:

a. a housing having a top end and a bottom end and an internal cavity therebetween, with a first aperture in the housing allowing access to the internal cavity and a second aperture in the housing;

b. a connector block having at least one aperture for electrical wiring and at least one aperture for mounting the connector block at a location in the internal cavity other than the bottom end, said apertures being cooperatively aligned with the first aperture in the housing and the second aperture in the housing respectively;

c. at least one float switch or air pressure switch coupled with the connector block in the internal cavity, said at least one float switch or air pressure switch having at least a first activating function shutting off a water valve and being electrically connected to a solenoid, motor or electric actuator of the water valve by electrical wiring passing through the at least one aperture for electrical wiring and the first aperture in the housing;

d. a cleanout plug suitable for a substantially vertical installation of the overflow preventer into a cleanout aperture of a sewerage or drainage system, the cleanout plug having a longitudinal bore therethrough; and e. a selectively removable cap, substantially sealing the bottom end of the housing to enable the accumulation of fluid in the housing, said cap having a nipple of a diameter cooperating with the longitudinal bore connected to and in fluid communications with the cleanout plug to permit fluid from the cleanout aperture to pass through the bottom end, accumulating in the housing and activating the at least one float switch or air pressure switch when the fluid reaches the at least one float switch or air pressure switch, opening or closing an electrical circuit connected to the solenoid, motor or electric actuator, shutting off the water valve.

2. The sewerage and drainage system overflow preventer device of claim 1, further comprising a terminal block for connecting the electrical wiring from the at least one float switch or air pressure switch to the solenoid, motor or electric actuator, said terminal block being mounted exteriorly to the housing and having a plurality of terminal block screws for selectively connecting the electrical wiring from the at least one float switch or air pressure switch to the solenoid, motor or electric actuator.

3. The sewerage and drainage system overflow preventer device of claim 2, further comprising an alarm module mounted exteriorly to the housing and electrically connected to the terminal block.

4. The sewerage and drainage system overflow preventer system of claim 3, further comprising an alarm block housing mounted exteriorly to the housing and encasing the alarm module.

5. The sewerage and drainage system overflow preventer device of claim 3, wherein the alarm module includes two or more of a visual alarm, an audio alarm, a telephone communication alarm, a text alarm, an email communication alarm, a data alarm, and a network communication alarm.

6. The sewerage and drainage system overflow preventer device of claim 1, further comprising a downward pipe connected to the housing proximate to the top end, said downward pipe discharging excess fluid from the housing.

7. The sewerage and drainage system overflow preventer device of claim 6, further comprising a plug closing the top end of the housing.

8. The sewerage and drainage system overflow preventer device of claim 3, further comprising an electrical relay to enable the at least one float switch or air pressure switch to perform a second activating function with one float switch or air pressure switch.

9. The sewerage and drainage system overflow preventer device of claim 8, wherein the second activating function is activating an alarm when the fluid accumulates in the housing.

10. The sewerage and drainage system overflow preventer device of claim 1, further comprising a cooperating grommet mounted in the at least one aperture for the electrical wiring to form a fluid-resistant seal around the electrical wiring.

11. The sewerage and drainage system overflow preventer device of claim 1, wherein fluid detection inside the housing comprises activating the at least one float switch or air pressure switch and opening or closing an electrical circuit connected to the solenoid, motor or electric actuator.

12. The sewerage and drainage system overflow preventer device of claim 1, wherein the least one float switch or air pressure switch is not magnetic.

13. The sewerage and drainage system overflow preventer device of claim 1, wherein the at least one float switch or air pressure switch is a first float switch or first air pressure switch with a first activating function and a second float switch or second air pressure switch with a second activating function, wherein the first activating function is shutting off a boiler gas valve when the fluid accumulates in the housing and triggers the first float switch or first air pressure switch and wherein the second activating function is activating an alarm when the fluid accumulates in the housing and triggers the second float switch or second air pressure switch.

14. A sewerage and drainage system overflow preventer device, comprising:

a. a housing having a top end connected to a first in-line arm of a first fluid Tee joint, also having a second in-line arm and a transverse arm, a bottom end capped with a removable cap having a nipple, and an internal cavity between the top end and the bottom end in fluid communication with the transverse arm, with an aperture in the housing allowing access to the internal cavity;

b. a cooperating core for insertion into the internal cavity, said cooperating core having a first open end and a second open end and at least one aperture therebetween for electrical wiring;

c. at least one float switch or air pressure switch mounted in the cooperating core between the first open end and the second open end, said at least one float switch or air pressure switch being electrically connected to a solenoid, motor or electric actuator of a water valve by electrical wiring passing through the aperture in the housing and through the at least one aperture in the cooperating core when the cooperating core is inserted into the internal cavity and the bottom end of the housing is capped with the removable cap;

d. a second Tee joint having a transverse arm connected to and in fluid communication with the transverse arm of the first fluid Tee joint;

e. an alarm module connected to an upward in-line arm of the second Tee joint and in electrical communication with the at least one float switch or air pressure switch; and f. a cleanout plug having a longitudinal bore therethrough connected to and in fluid communication with the nipple, the cleanout plug being suitable for a substantially vertical installation of the overflow preventer into a cleanout aperture of a sewerage or drainage system, wherein the fluid from the cleanout aperture accumulates in the internal cavity of the housing through the cleanout plug and the nipple and fills the cooperating core therein, activating the at least one float switch or air pressure switch mounted in the cooperating core when the fluid reaches the at least one float switch or air pressure switch and opening or closing the electrical circuit connected to the solenoid, motor or electric actuator, shutting off the water valve, and wherein excess fluid is discharged from the housing through a downward in-line arm of the second Tee joint opposite to the upward in-line arm.

15. The sewerage and drainage system overflow preventer device of claim 14, further comprising a plug closing the second in-line arm.

16. The sewerage and drainage system overflow preventer device of claim 14, wherein the alarm module includes two or more of a visual alarm, an audio alarm, a telephone communication alarm, a text alarm, an email communication alarm, a data alarm, and a network communication alarm.

17. A method of installing a sewerage and drainage system overflow preventer device, comprising:

a. providing a housing having a substantially closed top end, a substantially closed bottom end with a nipple, and an internal cavity between the top end and the bottom end, with an aperture in the housing allowing access to the internal cavity; and b. providing at least one float switch or air pressure switch mounted at a location in the internal cavity other than the bottom end, said at least one float switch or air pressure switch having at least a first activating function shutting off a water valve and being electrically connected to a solenoid, motor or electric actuator of the water valve by electrical wiring passing through the aperture, wherein the bottom end permits the accumulation of fluid in the housing through the nipple; and c. installing a cleanout plug, having a longitudinal bore connected to and in fluid communication with the nipple, into a cleanout aperture of a sewerage or drainage system, wherein the cleanout plug supports the overflow preventer substantially vertically and wherein said fluid passing from the cleanout aperture through the cleanout plug and the nipple activates the at least one float switch when the fluid reaches the at least one float switch or activates the at least one air pressure switch when the air pressure builds up in the internal cavity, opening or closing an electrical circuit connected to the solenoid, motor or electric actuator and shutting off the water valve.

18. The method of installing a sewerage and drainage system overflow preventer device of claim 17, further comprising tapping the longitudinal bore to cooperate with a thread of the nipple.

19. The method of installing a sewage and drainage system overflow preventer device of claim 17, further comprising providing an alarm module exteriorly coupled with the housing and electrically connected with the at least one float switch or air pressure switch.

20. The method of installing a sewage and drainage system overflow preventer device of claim 17, wherein the bottom end with the nipple is a selectively removable cap with the nipple, substantially sealing the bottom end of the housing to enable the accumulation of water in the housing.

* * * * *